US008134510B2

(12) United States Patent
Crouch et al.

(10) Patent No.: US 8,134,510 B2
(45) Date of Patent: Mar. 13, 2012

(54) COHERENT NEAR-FIELD ARRAY

(75) Inventors: David D. Crouch, Corona, CA (US); Michael J. Schweiger, Moreno Valley, CA (US)

(73) Assignee: Raytheon Company, Waltham, MA (US)

( * ) Notice: Subject to any disclaimer, the term of this patent is extended or adjusted under 35 U.S.C. 154(b) by 1143 days.

(21) Appl. No.: 11/501,563

(22) Filed: Aug. 9, 2006

(65) Prior Publication Data

US 2008/0036669 A1 Feb. 14, 2008

(51) Int. Cl.
*H01Q 19/06* (2006.01)
*H01Q 3/00* (2006.01)

(52) U.S. Cl. ..... 343/754; 343/755; 343/757

(58) Field of Classification Search ..... 343/354, 343/355, 357, 754, 755, 577
See application file for complete search history.

(56) References Cited

U.S. PATENT DOCUMENTS

| | | | | |
|---|---|---|---|---|
| 4,558,594 | A * | 12/1985 | Balser et al. | 73/170.16 |
| 6,061,033 | A | 5/2000 | Hulderman et al. | |
| 6,118,358 | A | 9/2000 | Crouch | |
| 6,157,349 | A | 12/2000 | Crouch | |
| 6,175,214 | B1 | 1/2001 | Mendoza et al. | |
| 6,243,047 | B1 | 6/2001 | Brown | |
| 6,252,558 | B1 | 6/2001 | Brown et al. | |
| 6,304,226 | B1 | 10/2001 | Brown et al. | |
| 6,353,220 | B1 | 3/2002 | Sar | |
| 6,522,226 | B2 | 2/2003 | Crouch et al. | |
| 6,693,605 | B1 | 2/2004 | Crouch et al. | |
| 6,765,535 | B1 | 7/2004 | Brown et al. | |
| 6,864,857 | B2 | 3/2005 | Crouch et al. | |
| 7,323,689 | B2 * | 1/2008 | Hawman | 250/363.04 |
| 7,382,329 | B2 * | 6/2008 | Kim | 343/757 |
| 7,425,928 | B2 * | 9/2008 | Chiang et al. | 343/754 |
| 7,427,962 | B2 * | 9/2008 | Yang | 343/757 |
| 2004/0038714 | A1 * | 2/2004 | Rhodes et al. | 455/562.1 |
| 2006/0045144 | A1 * | 3/2006 | Karlsen et al. | 372/9 |
| 2006/0077097 | A1 * | 4/2006 | Dybdal et al. | 342/359 |

OTHER PUBLICATIONS

Kim et al., "A Grid Amplifier", IEEE Microwave and Guided Wave Letters, vol. 1, No. 11, Nov. 1991, pp. 322-324.
David Rutledge et al., "Oscillator and Amplifier Grids", IEEE MTT-S Digest, 1992, pp. 815-818.
Popovic and Rutledge, Diode-Grid Oscillators, IEEE P-S International Symposium, Syracuse, New York, Jun. 1988.
Rutledge et al., "Active Grids for Quasi-Optical Power Combining", Signals, Systems and Electronics, ISSSE Proceedings, URSI International Symposium,Oct.1995, pp. 141-144.
C.A. Balanis, "Antenna Theory", John Wiley and Sons, N.Y., 1997, p. 597.

* cited by examiner

*Primary Examiner* — Trinh Dinh
(74) *Attorney, Agent, or Firm* — Christie, Parker & Hale, LLP

(57) ABSTRACT

A coherent near-field array. The array consists of a number of high-gain elements, each of which directs its beam at the desired target area (either mechanically or electronically). Each element is coherently fed, so that the phase relationships between different feeds are constant or slowly varying. The elements in the array may be spaced many wavelengths apart. The array relies on interference to generate a number of power density peaks within the target area.

26 Claims, 24 Drawing Sheets

FIG. 2b
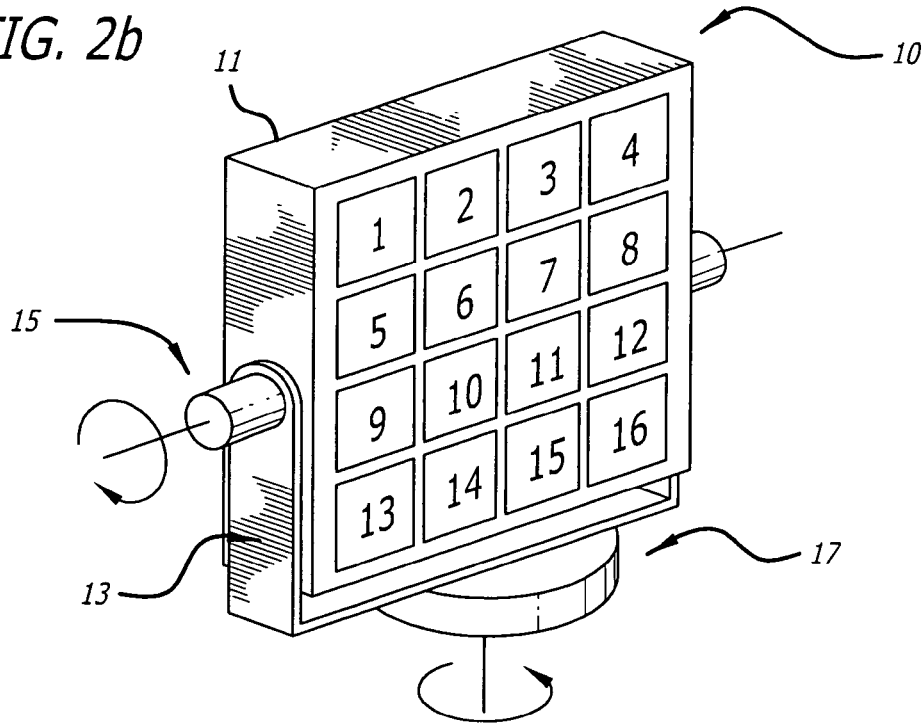
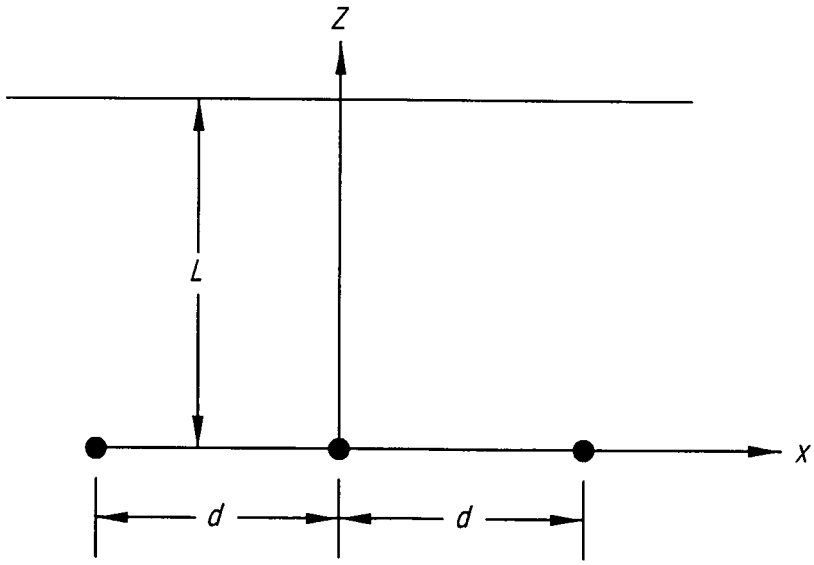
FIG. 2c

FIG. 15
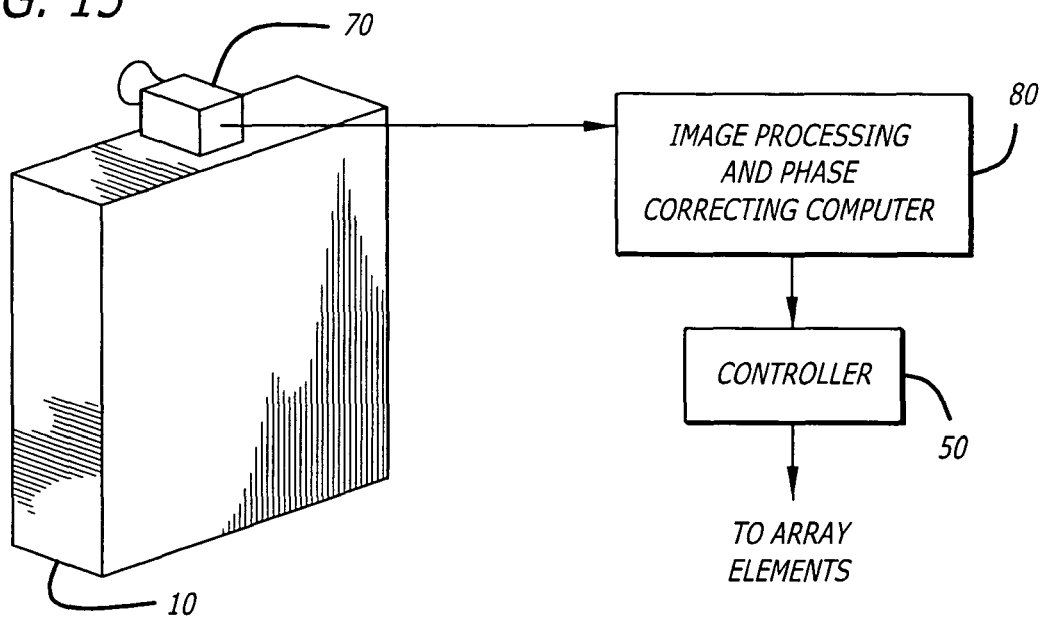
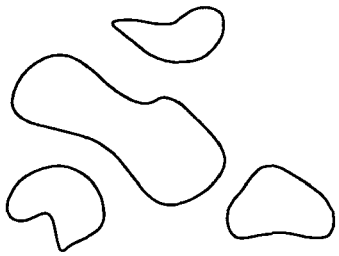
FIG. 16a
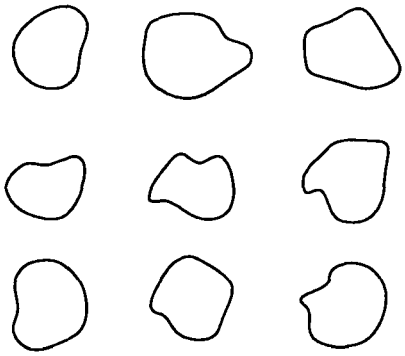
FIG. 16b

COHERENT NEAR-FIELD ARRAY

BACKGROUND OF THE INVENTION

1. Field of the Invention

The present invention relates to antennas. More specifically, the present invention relates to millimeter-wave antennas and arrays thereof.

2. Description of the Related Art

As noted by the Institute of Electrical and Electronic Engineers (IEEE): "The millimeter-wave region of the electromagnetic spectrum is usually considered to be the range of wavelengths from 10 millimeters (0.4 inches) to 1 millimeter (0.04 inches). This means they are larger than infrared waves or x-rays, for example, but smaller than radio waves or microwaves. The millimeter-wave region of the electromagnetic spectrum corresponds to radio band frequencies of 30 GHz to 300 GHz and is sometimes called the Extremely High Frequency (EHF) range. The high frequency of millimeters waves as well as their propagation characteristics (that is, the way they change or interact with the atmosphere as they travel) make them useful for a variety of applications including transmitting large amounts of computer data, cellular communications, and radar." See http://www.ieee-virtual-museum. org/collection/tech.php!id=2345917&lid=1.

In addition, non-lethal directed-energy weapons have recently been developed that use beams of millimeter-wave electromagnetic energy to deter advancing adversaries. In this application, high-power millimeter-wave beams carrying tens to thousands of watts are used to stop, deter and turn back an advancing adversary from a relatively long range.

Prior attempts to produce high-power millimeter-wave beams carrying hundreds or thousands of watts have focused on the use of a single vacuum-electron device such as a traveling-wave tube, a klystron, or a gyrotron as a millimeter-wave source. Systems built around such sources are typically large and heavy, thus limiting the platforms onto which they can be integrated.

Prior attempts to produce millimeter-wave beams with solid-state devices have utilized waveguide, microstrip, and quasi-optical power combining techniques. At millimeter-wave frequencies, waveguide and microstrip power combining typically produce unsatisfactory results due to excessive losses in the waveguide and/or microstrip medium. One current approach involves he use of a reflect array amplifier. The reflect array has independent unit cells, each containing its own input antenna, power amplifier, and output antenna. These unit cells are then configured into an array of arbitrary size. Reflect arrays overcome feed losses by feeding each element via a nearly lossless free-space transmission path. As disclosed and claimed in U.S. Patent Application entitled REFLECTIVE AND TRANSMISSIVE MODE MONOLITHIC MILLIMETER WAVE ARRAY SYSTEM AND IN-LINE AMPLIFIER USING SAME, U.S. application Ser. No. 10/734,445, filed Dec. 12, 2003 by K. Brown et al., the teachings of which are hereby incorporated herein by reference, reflect arrays differ from conventional arrays in that the input signal is delivered to the face of the array via free space, generally from a small horn antenna.

An active reflect array consists of a large number of unit cells arranged in a periodic pattern. Each reflect array element is equipped with two orthogonally-polarized antennas, one for reception and one for transmission. That is, reflect arrays typically receive one linear polarization and radiate the orthogonal polarization, e.g., the receive antenna receives only vertically-polarized radiation and the transmit antenna transmits only horizontally-polarized radiation.

Higher power levels are attained by combining the outputs of multiple transistors. The drawback of this approach is that the power combiners themselves take up valuable area on the semiconductor wafer that could otherwise be occupied by power-generating circuitry.

Consequently, there was a need in the art for an improved system or method for generating a high-power millimeter-wave beam. Specifically, there was a need for a reflect array antenna capable of generating high-power millimeter-wave energy without significant loss.

The need was addressed by copending U.S. patent application Ser. No. 11/508,806 entitled AMPLIFIED PATCH ANTENNA REFLECT ARRAY, filed Aug. 22, 2006 by K. W. Brown the teachings of which are hereby incorporated by reference herein. although this design addressed the need in the art, the array required high current levels due to the parallel orientation of the amplifier columns in the array with respect to the direct current fee thereof. With multiple parallel columns in the array and potentially multiple chips, thousands of amps of current may be required. This requires high current cabling and tends to be lossy. This translates to higher power requirements, higher costs and more bulky arrays.

Hence, a need remained in the art for further improvements to systems and methods for generating high-power millimeter-wave beams. Specifically, a need remained for a reflect array antenna capable of generating high-power millimeter-wave energy with minimal power requirements.

This need was addressed by copending U.S. patent application Ser. No. 11/508,085 entitled SERIES FED AMPLIFIED PATCH ANTENNA REFLECT ARRAY, filed Aug. 22, 2006 by K. W. Brown the teachings of which are hereby incorporated by reference herein.

Millimeter-wave energy is useful for non-lethal directed-energy applications because it penetrates less than $1/64^{th}$ of an inch into the skin and produces an intense burning sensation that stops when the transmitter is switched off or when the individual moves out of the beam. Realization of this effect requires that the power density exceed a minimum value $P_{min}$.

As disclosed in the above-referenced patents and applications, projection of the minimum required electromagnetic power density over a target area of sufficient size at the desired range requires a sizable transmitter, consisting of a millimeter-wave source, a power supply, a cooling system, and other support equipment. The size and weight of the system are determined primarily by the total radiated power, which in turn is determined by the desired range and the size of the target area to be illuminated.

Conventional systems generate a single beam whose power density is maximal at the center of the target area and decreases monotonically with distance from the center. If it is desired to illuminate a target area of radius $\rho_0$ over which the power density is to exceed $P_{min}$ at a distance R from the transmitter, the total radiated power required is that which produces a spot whose power density falls to $P_{min}$ at a distance $\rho_0$ from the center. The power density at the center of the target area is typically between one and two times $P_{min}$. As it is difficult to refocus systems of conventional design, targets at ranges $r<R$ cannot in general be optimally illuminated.

Hence, to project the minimum required electromagnetic power density over a spot of sufficient size at the desired ranges by conventional means requires a large transmitter, consisting of a millimeter-wave source, a power supply, a cooling system, etc. The size and weight of such a transmitter limits the platforms capable of supporting such a system. This is a problem that is common to directed-energy systems in general. In the past, this problem was solved by trading increased antenna size for transmitter size and weight reductions. That is, by increasing the size of the antenna to produce more gain, one can achieve the desired power density at range with a smaller transmitter. This trade-off can be carried only so far, since the projected beam of electromagnetic energy shrinks in cross section as the antenna gain increases, reducing the coverage area and putting increased demands on the antenna pointing and tracking accuracy.

In short, conventional millimeter-wave systems of conventional design generate beams having definite power densities at a given range with considerable associated size, weight, cost and power requirements. Further, conventional systems do not allow for the range of the antenna at which power is optimized to be adjusted dynamically.

Hence, a need remains in the art for a millimeter-wave system that offers improved coverage with lower associated size, weight, cost and power requirements.

SUMMARY OF THE INVENTION

The need in the art is addressed by the antenna array of the present invention. In the illustrative embodiment, the array includes a plurality of elements and an arrangement for independently steering a beam output by each of the elements.

The elements may be radiating or reflecting and may be separately fed. The amplitude and phase of the signals radiated or reflected by the antennas are adjusted to create an interference pattern at the target with power density peaks therein. Each element may be mounted randomly or on an independently mobile platform. Further, each element may itself be a phased array.

In the illustrative embodiment, the invention is a coherent near-field array. The array consists of a number of high-gain elements, each of which directs its beam at the desired target area (either mechanically or electronically). Each element is coherently fed, so that the phase relationships between different feeds are constant or slowly varying. The elements in the array may be spaced many wavelengths apart. The array relies on interference to generate a number of power density peaks within the target area.

BRIEF DESCRIPTION OF THE DRAWINGS

FIG. 2*b* is a diagram of an illustrative hardware implementation of the array of the present invention.

FIG. 2*c* is a simplified diagram of a three-element linear array of isotropic elements.

FIG. 15 is a simplified diagram of an illustrative closed-loop implementation in accordance with the present teachings.

FIG. 16*a* shows an illustrative downrange thermal signature received by the camera 70 of FIG. 15 in accordance with the present teachings.

FIG. 16*b* shows a desired downrange thermal signature received by the camera of FIG. 15 as a result of the effect of the controller in accordance with the present teachings.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

In accordance with the present teachings, a coherent near-field array is disclosed that uses a distributed array of radiating or reflecting elements to illuminate a desired target area with energy which creates isolated "hot spots" in which the power density peaks and, therefore, can be optimized to meet or exceed a desired threshold. In the illustrative embodiment, each element of the array radiates a beam that illuminates all or part of the target area. Nonetheless, those skilled in the art will appreciate that the present teachings may be extended to an array of reflective elements without departing from the scope of the invention.

In either case, the beams radiated or reflected by each element are mutually coherent and are arranged and phased in such a way that the separate beams interfere constructively over some parts of the target area and destructively over others. That is, the beams are at substantially the same frequency with fixed or slowly varying inter-element phase relationships.

In the best mode, the beams are mutually coherent; otherwise, the time-averaged power density at any point in the target area will be the sum of the power densities due to each element. Without mutual coherence, there is no interference between beams from different elements and the total power that must be radiated to illuminate the desired target area increases significantly. With mutual coherence, the desired coverage can be obtained within the target area with reduced total radiated power. As a result, the size and weight of the transmitter are reduced. This may make possible installation of directed-energy systems on platforms that could not otherwise support the size and/or weight of a conventional system. Moreover, a large system can be constructed from multiple small mutually-coherent systems and distributed on or within a given platform, reducing the impact of a single-system failure.

Figure 1:
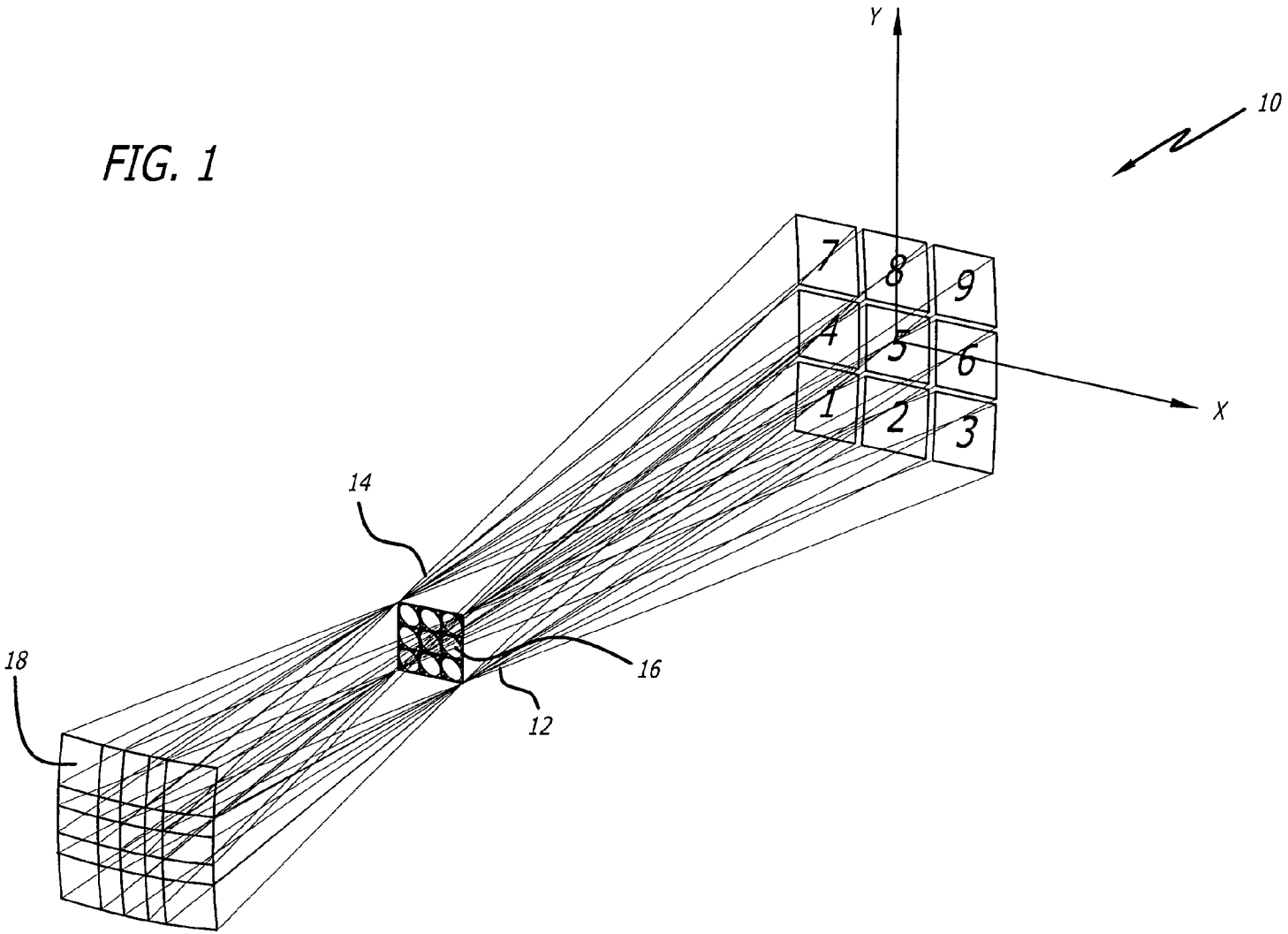
FIG. 1 is a simplified diagram of a generic 3×3 coherent near-field array consisting of nine separate radiating or reflecting elements (1-9) arranged on a square grid.

FIG. 1 is a simplified diagram of a generic 3×3 coherent near-field array 10 consisting of nine separate radiating or reflecting elements (1-9) arranged on a square grid. Each element is tilted in azimuth and elevation so that the projection of a normal vector at the center of each element will pass through the center of the target area at a target point at a desired distance along the z-axis. Each element radiates a separate beam having a common frequency and a fixed phase relationship to all other beams.

As illustrated in FIG. 1, the beams converge at the target area 12 and form an interference pattern 14 that results in the creation of a number of isolated hot spots 16. Interference occurs only near the target point in the near field of the array. Further from the array, the individual beams diverge; in the far field 18, the array pattern is the sum of the individual element patterns. Note that it is not required that each element is square, nor is it required that the elements be arranged on a square grid. The elements and the array can even be of different shapes without departing from the scope of the present invention.

Minimization of system size and weight requires that the total radiated power be minimized. The present invention makes maximum use of interference between the beams radiated by each radiating element in order to obtain numerous hot spots within the target area separated by areas of low power density. Interference can occur only if the beams overlap in the target area. The requirement that each element project most of its power into the target area at the desired range places certain demands on the area of each element. At microwave frequencies, if one assumes that the target is in the near field of the array, but in the far field of each individual element, then the far-field 3 dB beam width of a single square uniform aperture having sides of length D at a distance R is given by:

$$W_{3\mathrm{dB}} = R\Delta\theta_{3\mathrm{dB}} = R\frac{\pi}{180}\frac{50.6}{D/\lambda}. \quad [1]$$

See Antenna Theory, written by C. A. Balanis, published by John Wiley and Sons, New York, 1997, p. 597. Note that the target area need not be in the far field of each element. At optical frequencies, it is possible that the target area will be in the near field of both the array and each individual array element.

Given a desired 3 dB beam width $W_{3dB}$, the estimated element size D is obtained as follows:

$$\frac{D}{\lambda} = R\frac{\pi}{180}\frac{50.6}{W_{3\mathrm{dB}}}. \quad [2]$$

For example, if the target area is a square $W_{3dB}$=0.7 meters on a side at a range of R=250 meters, then the element size will be D≧1.19 meters when λ=3.16 mm (f=95 GHz).

The pattern radiated by a smaller aperture will be broader and more of the radiated power will fall outside the target area. For the beams to interfere, they must overlap, which requires that each element be pointed at the target area. In addition, the proper phases should be applied to each element if a particular interference pattern is desired. In accordance with the present teachings, actuators are used to point each element at the target, and because the element phase values needed to create a desired interference pattern are range dependent, means are provided for determining the range to the target (e.g., radar, laser rangefinder, etc.).

Figure 2A:
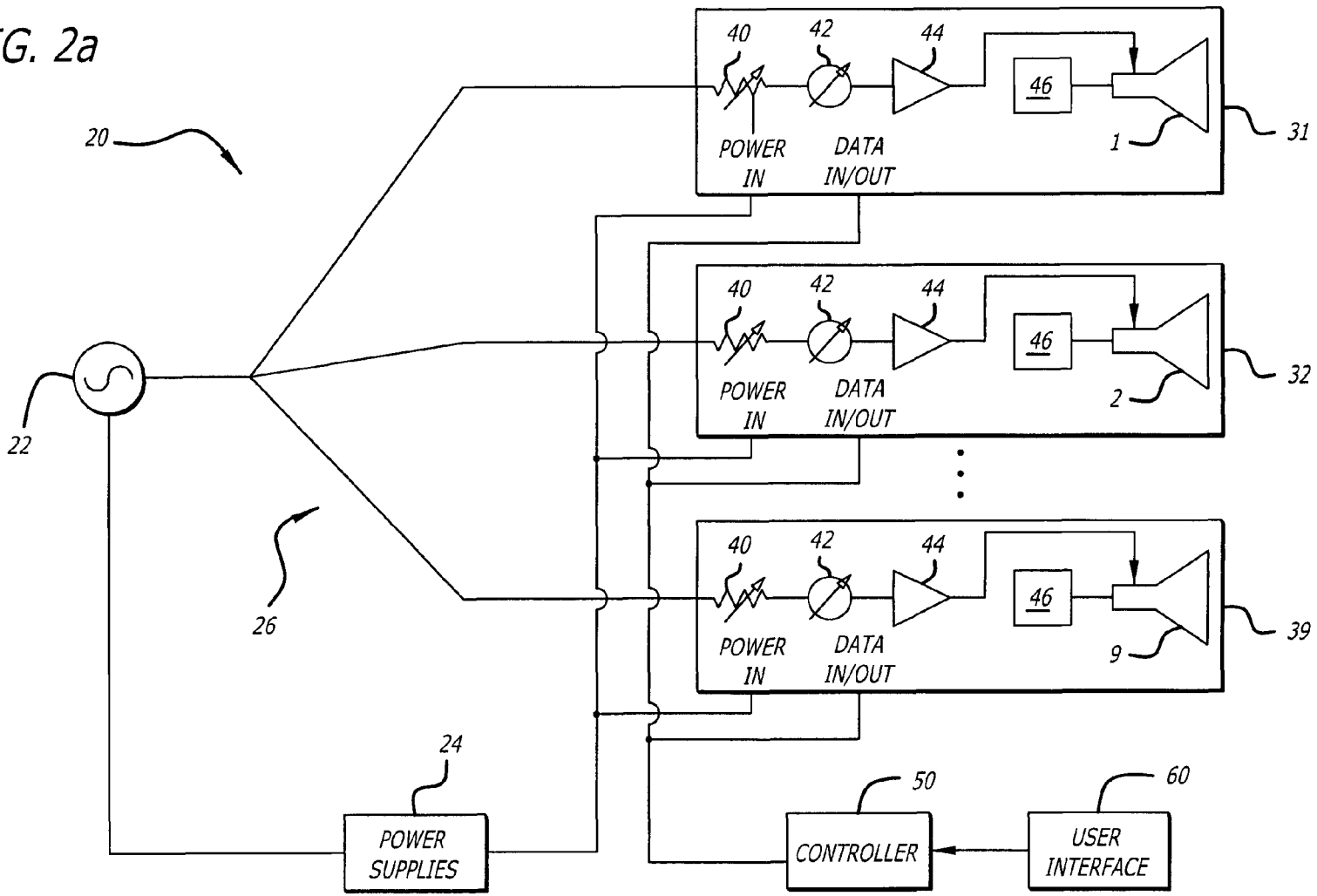
FIG. 2*a* is a simplified block diagram of an illustrative implementation of an electrical system for use with the array of the present invention.

FIG. 2*a* is a simplified block diagram of an illustrative implementation of an electrical system for use with the array of the present invention. As shown in FIG. 2*a*, the system 20 includes a master oscillator 22. The system 20 is powered by a power supply 24. The oscillator 22 provides high frequency (in the illustrative embodiment, millimeter-wave) energy to a high-frequency distribution network 26. The network 26 feeds each of the radiating elements 1-9. In the illustrative implementation with radiating elements in lieu of reflecting elements, each element 1-9 is disposed within an associated module 31-39 respectively.

In the illustrative embodiment, each module includes a variable attenuator 40, variable phase shifter 42, variable power amplifier 44, an actuator 46 and a radiating element 1-9. The variable attenuator 42 allows the controller to set the amplitude of the signal input to the amplifier 44. The controller 50 regulates the phase shift of each element via the variable phase shifter 42. The variable power amplifier 44 effects amplitude control of the output of each radiating element in response to a signal from the controller 50. Inputs to the controller 50 are provided via a user interface 60. The pointing angle of each radiating element is controlled via the actuator 46, controller 50 and user interface 60. Each element 1-9 is mounted on a gimbal for rotation about at least two orthogonal (e.g. azimuth and elevation or pitch and yaw) axes in response to physical actuation by pistons, solenoids, piezoelectric transducers, microelectromechanical (MEMS) devices or other arrangement known in the art (not shown) in the actuator 46. Those skilled in the art will appreciate that the variable power amplifier 44 may be replaced by a conventional power amplifier without departing from the scope of the present teachings.

FIG. 2*b* is a diagram of an illustrative hardware implementation of the array of the present invention. As shown in FIG. 2*b*, the array 10 includes a plurality of elements 1, 2, 3, . . . , 16 mounted within a housing 11. The housing 11 is mounted on a conventional gimbal 13 and is tilted via an elevation motor 15. The elevation motor 15 is mounted on the gimbal axis which is coaxial with the 'x' axis of the array 10. The elevation motor is actuated by the controller 50 of FIG. 2*a*. An azimuth motor 17 is mounted to adjust the pointing angle of the array 10 along the 'y' axis thereof in response to signals from the controller 50. In accordance with the present teachings, each element 1-16 may be mounted on a similar structure and actuated by the actuators 46 in response to the controller. Further, each element 1-16 may itself be an array of elements.

The size and shape of the interference pattern formed by the beams from all array elements is determined primarily by the physical layout of the array (particularly the distance between array elements) and by the phases of the individual elements. This can be demonstrated simply using a one-dimensional array of isotropic radiators. Consider a three-element linear array such as that shown in FIG. 2*c*.

FIG. 2*c* is a simplified diagram of a three-element linear array of isotropic elements. Suppose that the array elements are distributed along a line with a fixed distance d between neighboring elements. In FIG. 2*c*, the distance between elements is 'd' and the power radiated by the array is calculated along a line parallel to and displaced from the array by a distance 'L'. To ascertain the radiated power density along a line a distance L from the array, note that if the array consists of n=2N+1 elements located at positions $x_1=-Nd$, $x_2=-(N-1)d, \ldots, x_{N+1}=0, \ldots, x_{2N}=(N-1)d$, $x_{2N+1}=Nd$, then the power density along a line parallel to the array but displaced by a distance L is proportional to $$P \propto \left| \frac{1}{4\pi L} \sum_{n=1}^{2N+1} \exp\left(-jk\sqrt{(x-x_n)^2+L^2}\right)\exp(-j\Phi_n) \right|^2. \quad [3]$$

Here $\Phi_n$ is the excitation phase of the $n^{th}$ element and it is assumed that the amplitude factor $1/\sqrt{(x-x_n)^2+L^2} \cong 1/L$.

Figure 3A:
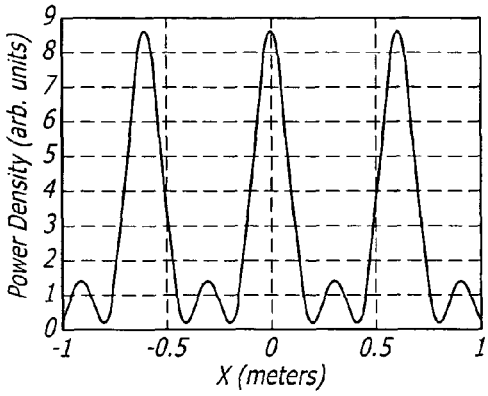
FIGS. 3*a*-*d* show illustrative interference patterns from a 3-element linear array.
Figure 3B:
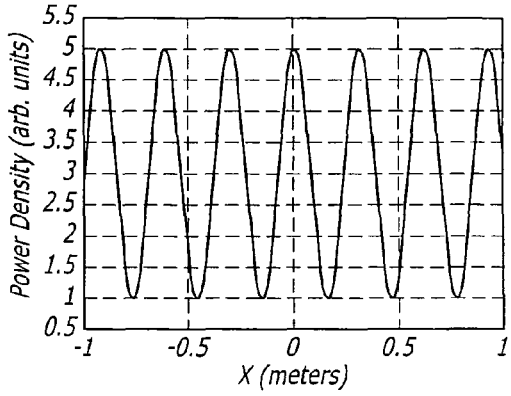
Figure 3C:
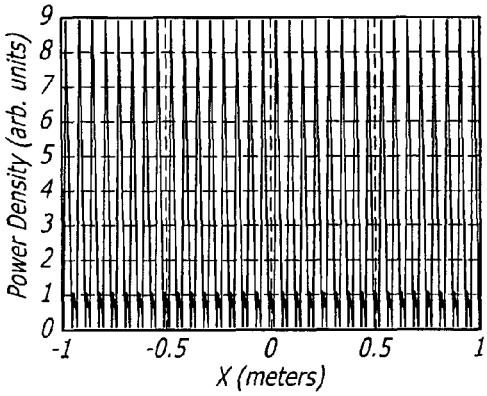
Figure 3D:
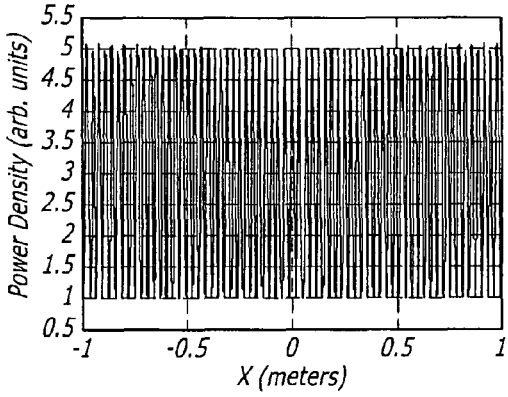

FIGS. 3*a-d* show illustrative interference patterns radiated by a 3-element linear array. In FIG. 3*a*, d=1.3 meters, L=250 meters, and the phase relationships are $(\Phi_1, \Phi_2, \Phi_3)=(0°, 0°, 0°)$. In FIG. 3*b*, d=1.3 meters, L=250 meters, and the phase relationships are $(\Phi_1, \Phi_2, \Phi_3)=(64°, 0°, 64°)$. In FIG. 3*c*, d=13 meters, L=250 meters, and the phase relationships are $(\Phi_1, \Phi_2, \Phi_3)=(0°, 0°, 0°)$. In FIG. 3*d*, d=13 meters, L=250 meters, and the phase relationships are $(\Phi_1, \Phi_2, \Phi_3)=(77°, 0°, 77°)$.

When d=1.3 meters, L=250 meters, and $(\Phi_1, \Phi_2, \Phi_3)=(0°, 0°, 0°)$, the interference pattern shown in FIG. 3*a* is obtained at a frequency of 95 GHz.

The sizes of the peaks can be equalized by adjusting the phases of the first and last elements so that $(\Phi_1, \Phi_2, \Phi_3)=(64°, 0°, 64°)$. The corresponding interference pattern is shown in FIG. 3*b*. The peaks are of nearly equal amplitude and the distance between peaks is approximately 0.3 meters.

Now consider a three-element array for which d=13 meters. The interference pattern at L=250 meters that results when $(\Phi_1, \Phi_2, \Phi_3)=(0°, 0°, 0°)$ is shown in FIG. 3*c*. Once again the peaks are unequal in amplitude, but can be equalized by adjusting the element phases.

The equalized interference pattern shown in FIG. 3*d* is obtained when $(\Phi_1, \Phi_2, \Phi_3)=(77°, 0°, 77°)$. The peaks are once again of nearly equal amplitude, but are now separated by only 0.03 meters. Whether d=1.3 meters or 13 meters, the line at L =250 meters upon which the radiated power is calculated is in the near field of the array. This can be demonstrated by calculating the value of $2D^2/\lambda$, where D is the length of the array (for the linear array shown in FIG. 2*c*, D=2d). The distance $2D^2/\lambda$ is used to mark the transition between the near and the far fields; if $L \ll 2D^2/\lambda$, the line lies in the near field of the array. When d=1.3 meters, $2D^2/\lambda=4284$ meters, and when d=13 meters, $2D^2/\lambda=428{,}433$ meters. In both cases, $L \ll 2D^2/\lambda$, and the interference patterns are in the radiative near field region (also known as the Fresnel region) of the array.

Hence, it is apparent that for a linear array, the separation between peaks in the near field is a function of the distance between elements and that the peaks move closer together as the element separation increases. The peak amplitudes can be controlled and equalized by adjusting the element phases.

FIGS. 3*a-d* also show that two types of arrays can be constructed. For both array types, the element-to-element spacing d satisfies $d \gg \lambda$. The first is a phased array, in which tight control is exercised over the phase of each element, as in FIG. 3*b*. The second is an "un-phased" array to which no phase adjustments are made, as in FIG. 3*c*. In an un-phased array for which d>>D, the large distance between elements results in a much higher density of spots, so adequate target area illumination is achieved without phase control. The phases of individual elements in an un-phased array can be set to zero, as in FIGS. 3*a* and 3*c*, or they can be set to random values. Examples of both types of array will be discussed below, including arrays having random element phases. Since a two-dimensional planar array is simply an array of one-dimensional linear arrays, the same conclusions apply to two-dimensional arrays, as will be demonstrated below.

The first millimeter-wave implementation is the phased array consisting of a 3×3 array of square elements as disclosed above with respect to FIGS. 1-3, with each element radiating at a frequency of 95 GHz.

Returning to the illustrative implementation of FIG. 1, each element is a uniform aperture, representing, for example, a uniformly illuminated square reflecting antenna. Those skilled in the art will appreciate that each element may be non-uniformly illuminated instead of uniformly illuminated without departing from the scope of the present teachings. Those skilled in the art will further appreciate that each element may be a radiating aperture (e.g., a horn antenna) instead of a reflecting antenna without departing from the scope of the present teachings.

Each aperture measures 1.25 meters on a side and the center-to-center separation thereof is 1.3 meters. The target area is assumed to lie on the axis of the array at a distance of 250 meters. The center of each element lies in the x,y plane, and each element is rotated as required so that it points at the center of the target area, i.e., at a point on the z axis a distance of 250 meters from the center of the array. No rotation is required of the center element. Elements 4 and 6 are rotated in azimuth by $\mathrm{Tan}^{-1}(\pm 1.3/250)=\pm 0.298$ degrees, respectively, while elements 2 and 8 are rotated by the same amounts in elevation. The corner elements 1, 3, 7, and 9 are rotated by ±0.298 degrees in both azimuth and elevation.

As disclosed in the context of the illustrative linear three-element array, it is necessary to adjust the relative phases of the elements in order to obtain spots of equal size and amplitude in the target area. The phases are computed using a simple formula:

$$\theta(n) = \left(\left|\frac{x(n)}{X_C}\right| + \left|\frac{y(n)}{Y_C}\right|\right)(\delta\theta), \quad [4]$$

where x(n) and y(n) are the coordinates of the center of the $n^{th}$ antenna element, $X_C$ and $Y_C$ are the center-to-center distances between elements along the x and y axes, respectively, and $\delta\theta$ is an empirically chosen phase constant used to adjust the power density pattern. Those skilled in the art will appreciate that other formulas or means may be used to determine the phases of individual elements without departing from the scope of the present teachings.

Figure 4:
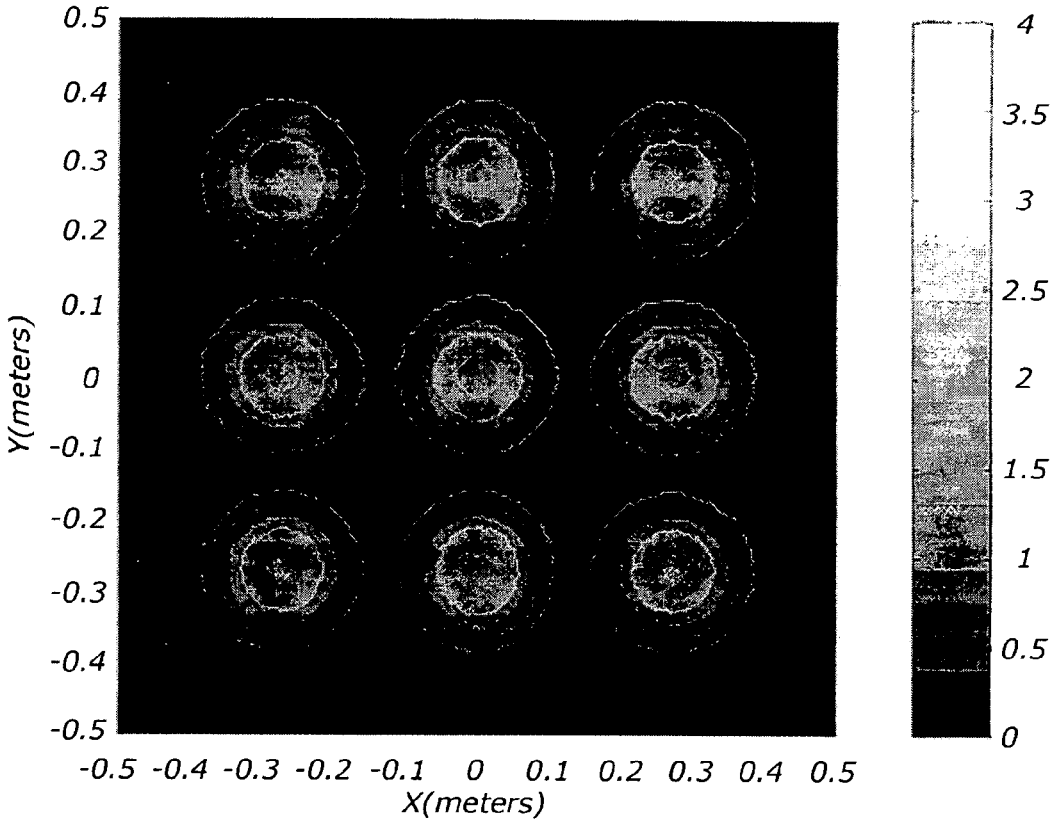
FIG. 4 shows an interference pattern illustrative of a normalized power density $P/P_{min}$ radiated by a 3×3 coherent near-field array at a distance of 250 meters in accordance with the present teachings.

FIG. 4 shows an interference pattern illustrative of a normalized power density $P/P_{min}$ radiated by a 3×3 coherent near-field array at a distance of 250 meters in accordance with the present teachings. FIG. 4 shows the calculated normalized power density pattern when $X_C=Y_C=1.3$ meters and $\delta\theta=140$ degrees. The total radiated power is $P_0$, and, if we assume the target area to be a square 1 meter on a side, the total radiated power falling in the target area is $0.35P_0$. At this range, a target will be illuminated by a normalized power density of $P_n=(P/P_{min})>1$ if located within approximately 0.33 meters of the center of the target area. The effective area of the power density pattern can be taken as $A_{effective}=(2\times0.33\ m)^2=0.44\ m^2$, so that 44% of the target area is effectively covered.

For purposes of comparison, consider a single uniformly illuminated square aperture 1.35 meters on a side. Such an aperture will illuminate a similarly sized area when the total radiated power is $3P_0$, as seen in FIG. 5.

Figure 5:
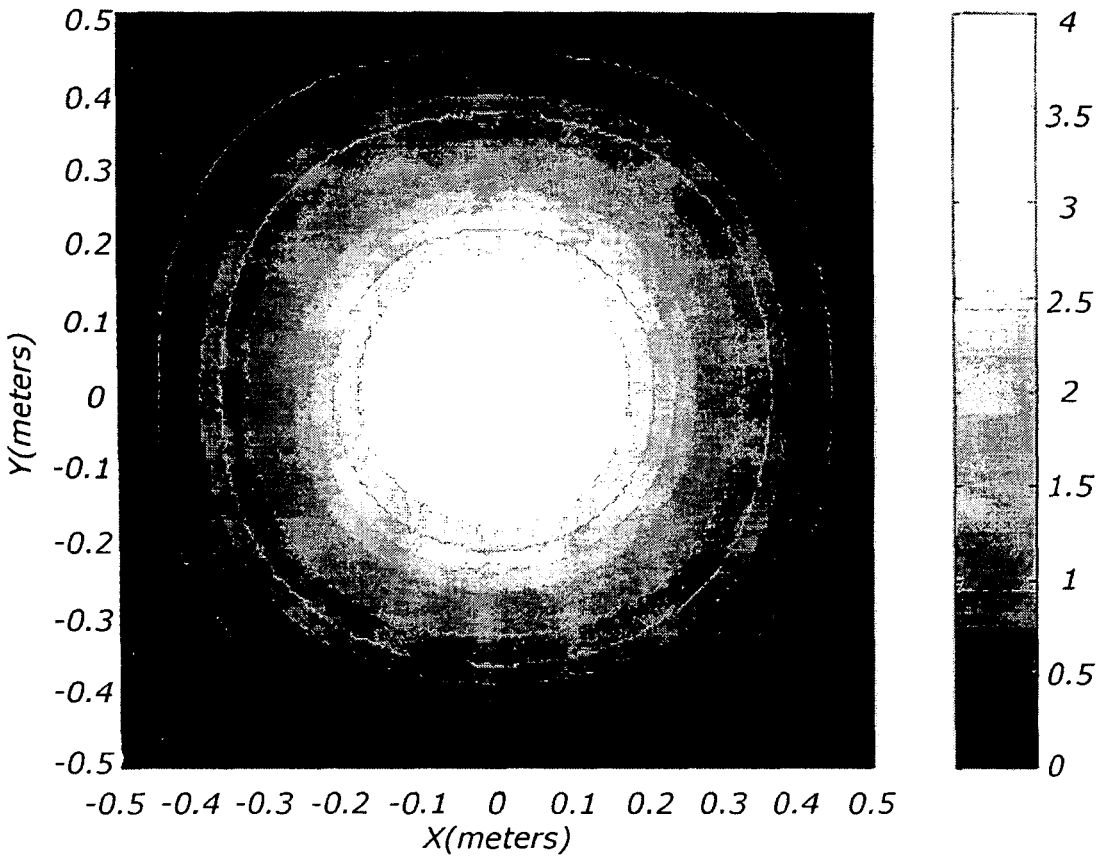
FIG. 5 shows an interference pattern with normalized power density $P/P_{min}$ radiated by a single uniform aperture at a distance of 250 meters in accordance with the present teachings.

FIG. 5 shows the normalized power density $P/P_{min}$ radiated by a uniform aperture at a distance of 250 meters in accordance with the present teachings. Here, total radiated power is $3P_0$. The percentage of the target area over which the normalized power density $P/P_{min}$ is greater than 1 is 41.5%. The coherent near-field array and the single aperture cover roughly the same area, but to do so the single aperture must radiate three times more power than the array. If a figure of merit equal to the ratio of effective area to total radiated power for the array divided by the same ratio computed for the equivalent single aperture is used, then:

$$FOM = \frac{\left(\frac{A_{effective}}{P_{tot}}\right)\Big|_{Array}}{\left(\frac{A_{effective}}{P_{tot}}\right)\Big|_{Aperture}} = \frac{\frac{0.44}{P_0}}{\frac{0.415}{3P_0}} = 3.18. \quad [5]$$

That is, when the effective illumination area and the total radiated power are used as criteria, the array is 3.18 times more effective in illuminating the target area than a single aperture.

It must be emphasized that there is not a one-to-one correspondence between the hot spots seen in FIG. 4 and the individual array elements. Each spot owes its existence to constructive interference between the beams radiated by all array elements. This is easily demonstrated by examining the power density due to a single element whose total radiated power is $P_0/9$. The resulting power density is plotted in FIG. 6.

Figure 6:
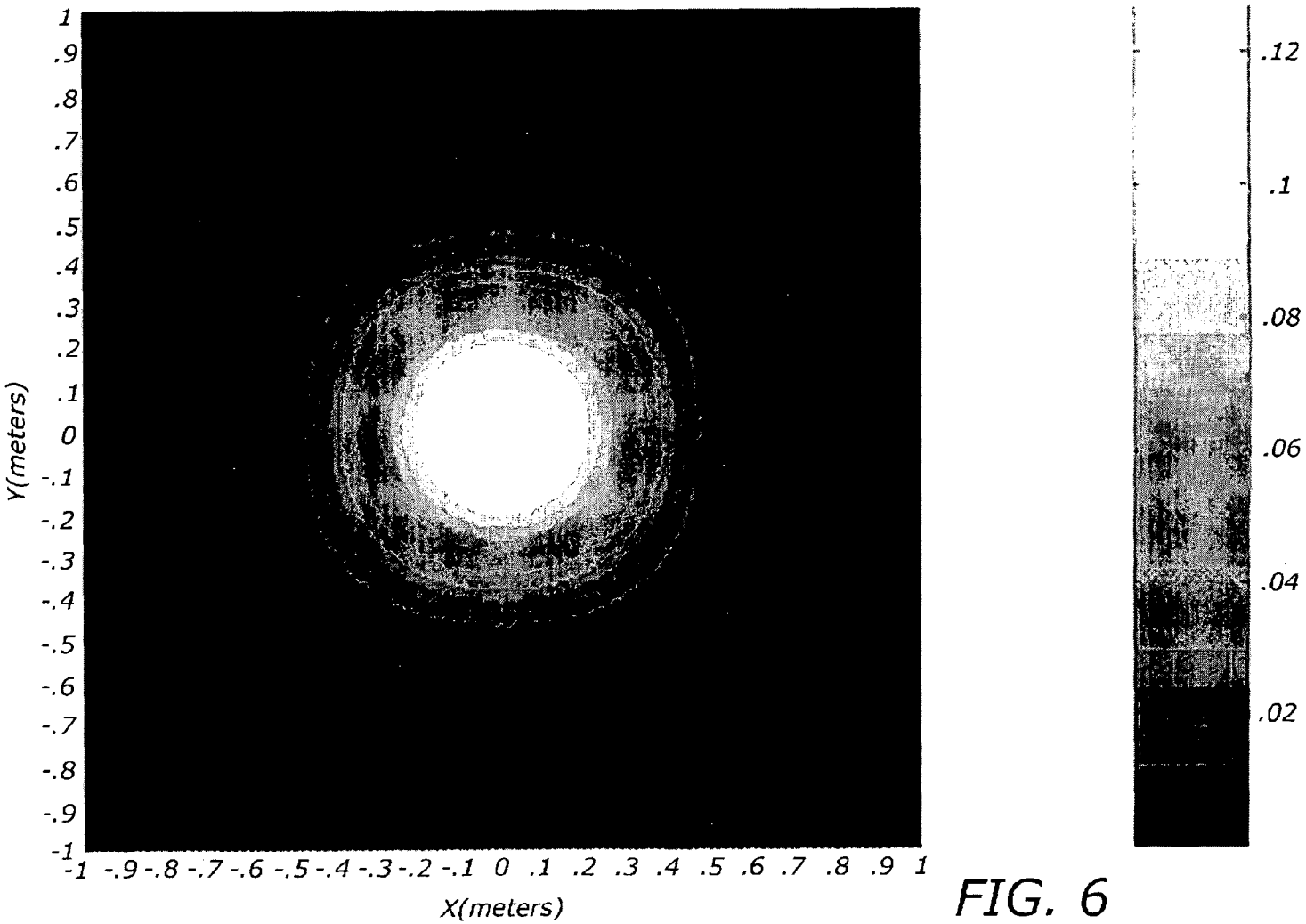
FIG. 6 is an interference pattern with a normalized power density $P/P_{min}$ radiated by a single aperture of a 3×3 array at a distance of 250 meters in accordance with the present teachings.

FIG. 6 is the normalized power density pattern $P/P_{min}$ radiated by a single element of the 3×3 array that generated the interference pattern shown in FIG. 4 at a distance of 250 meters in accordance with the present teachings. Here, the total radiated power is $P_0/9$. The peak normalized power density is 0.127, far below the threshold and more than a factor of 10 less than that realized by the nine-element array. The power density at the target due to a single element is insufficient to generate power densities such as those illustrated in FIG. 4.

If each element can be independently pointed at the target area, then the system can be used to illuminate targets at varying ranges. For example, assume that the same system used to produce the pattern shown in FIG. 4 is used to illuminate a target at a range of 200 meters. When each element is pointed at the target, the power density obtained is shown in FIG. 7.

Figure 7:
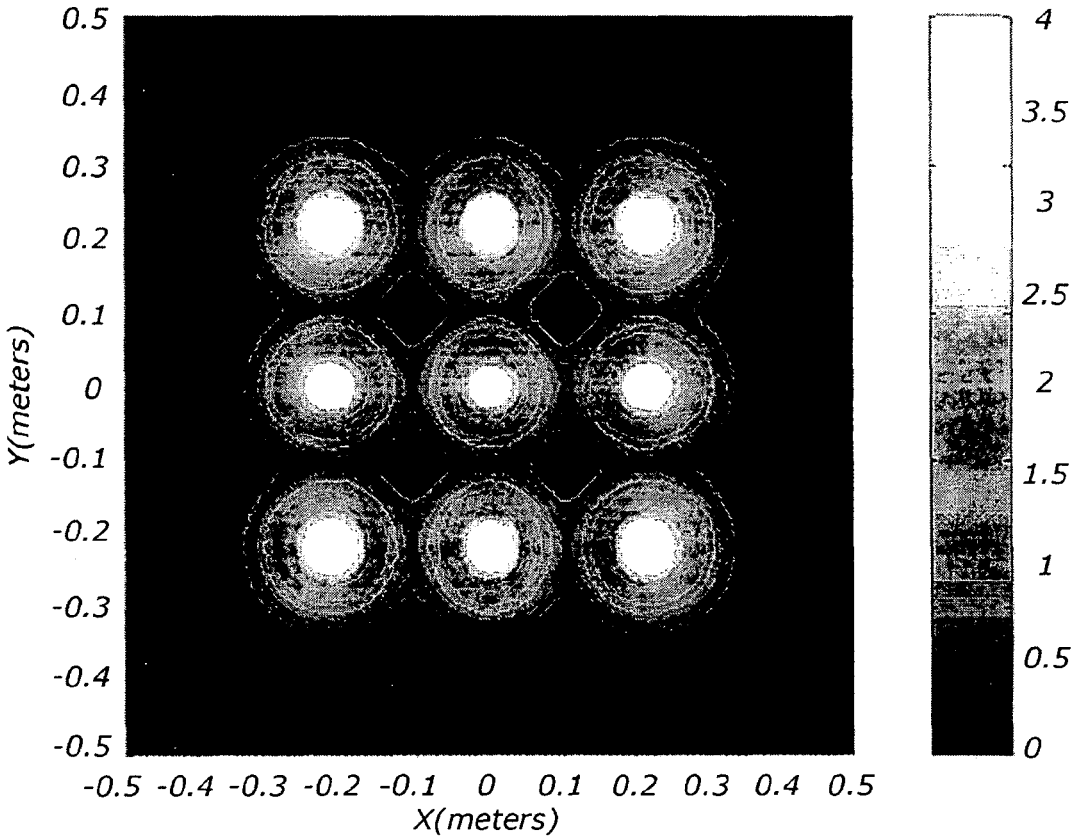
FIG. 7 is an interference pattern with a normalized power density $P/P_{min}$ radiated by a 3×3 coherent near-field array at a distance of 200 meters in accordance with the present teachings.

FIG. 7 is an interference pattern with a normalized power density $P/P_{min}$ radiated by a 3×3 coherent near-field array at a distance of 200 meters in accordance with the present teachings. Moreover, it is not required that the range to the target be known to a high degree of precision. The power densities for the same system (with all elements pointed at the target point at a range of 200 meters) at ranges of 195 meters and 205 meters are shown in FIG. 8.

Figure 8A:
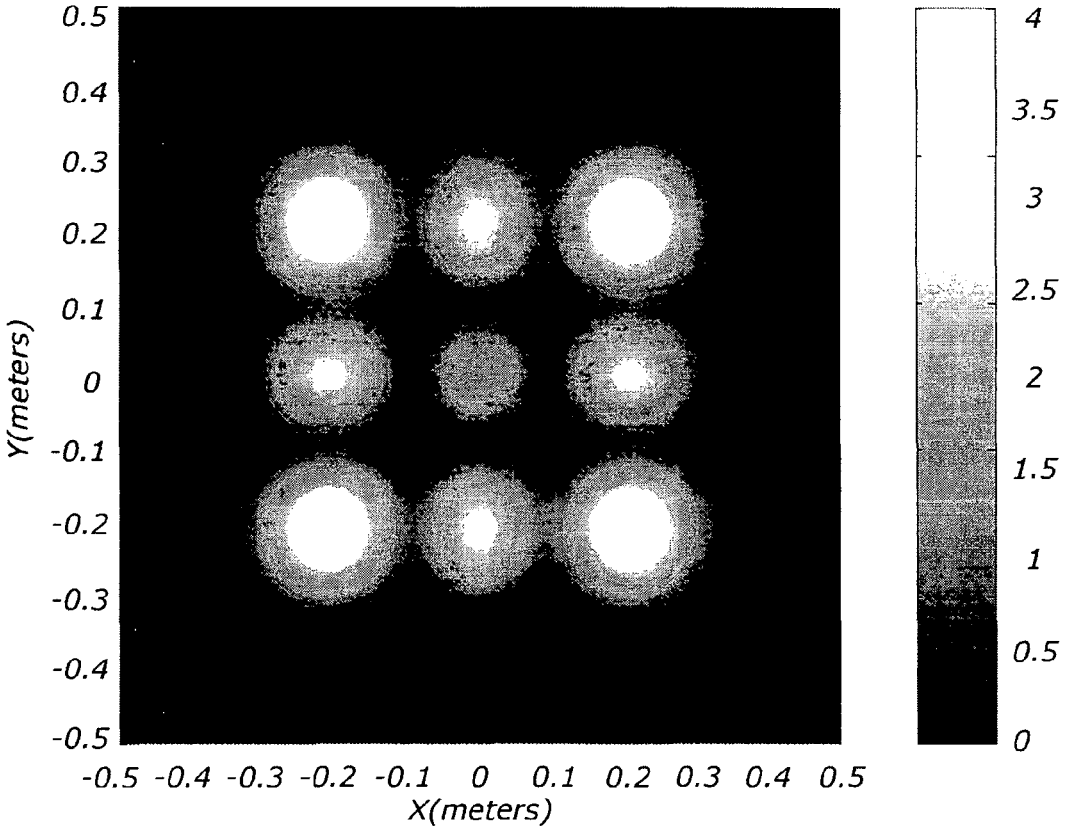
FIGS. 8*a* and 8*b* are a set of interference patterns that illustrate sensitivity of array performance to range in accordance with the present teachings.
Figure 8B:
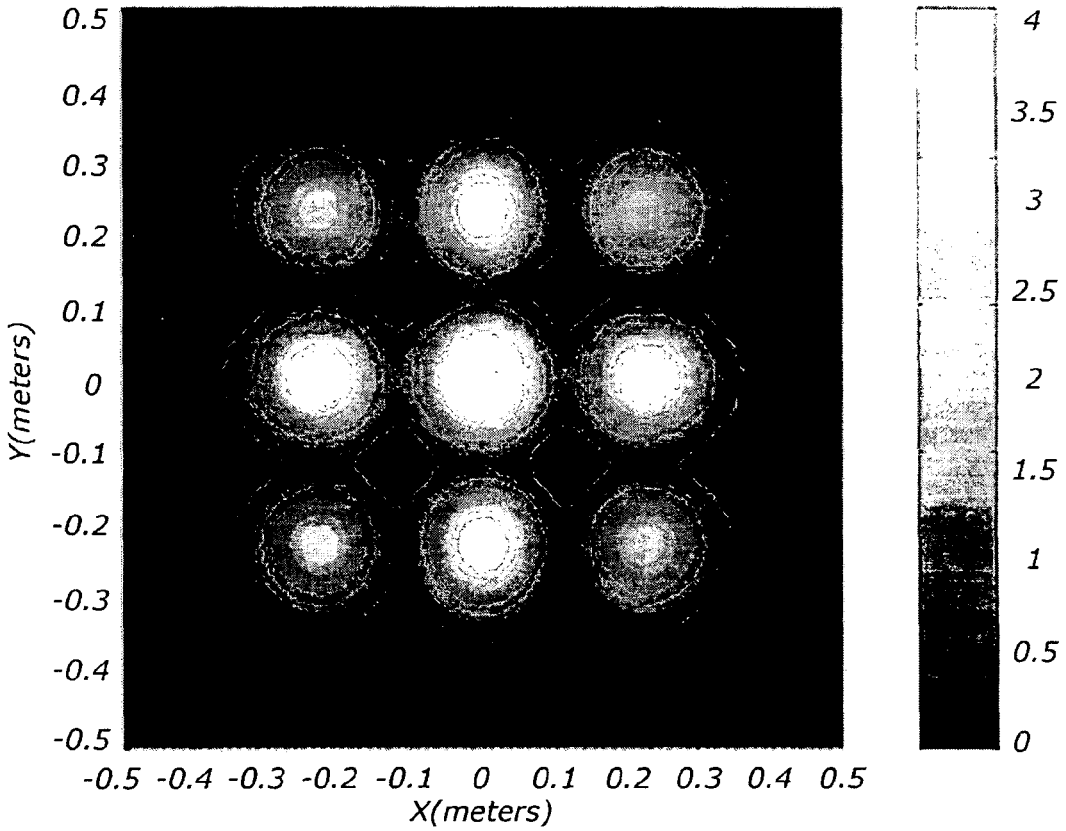

FIGS. 8*a* and 8*b* are a set of calculated interference patterns that illustrate sensitivity of array performance to range in accordance with the present teachings. In FIG. 8*a* power density is computed at 195 meters and the array is focused at 200 meters. In FIG. 8*b*, power density is computed at 205 meters and the array is focused at 200 meters.

In some situations a single spot of maximum intensity is desired rather than multiple lower intensity spots. Such a spot is generated simply by adjusting the element phases so that each element adds in phase at the center of the target point. This is illustrated in FIG. 9.

Figure 9:
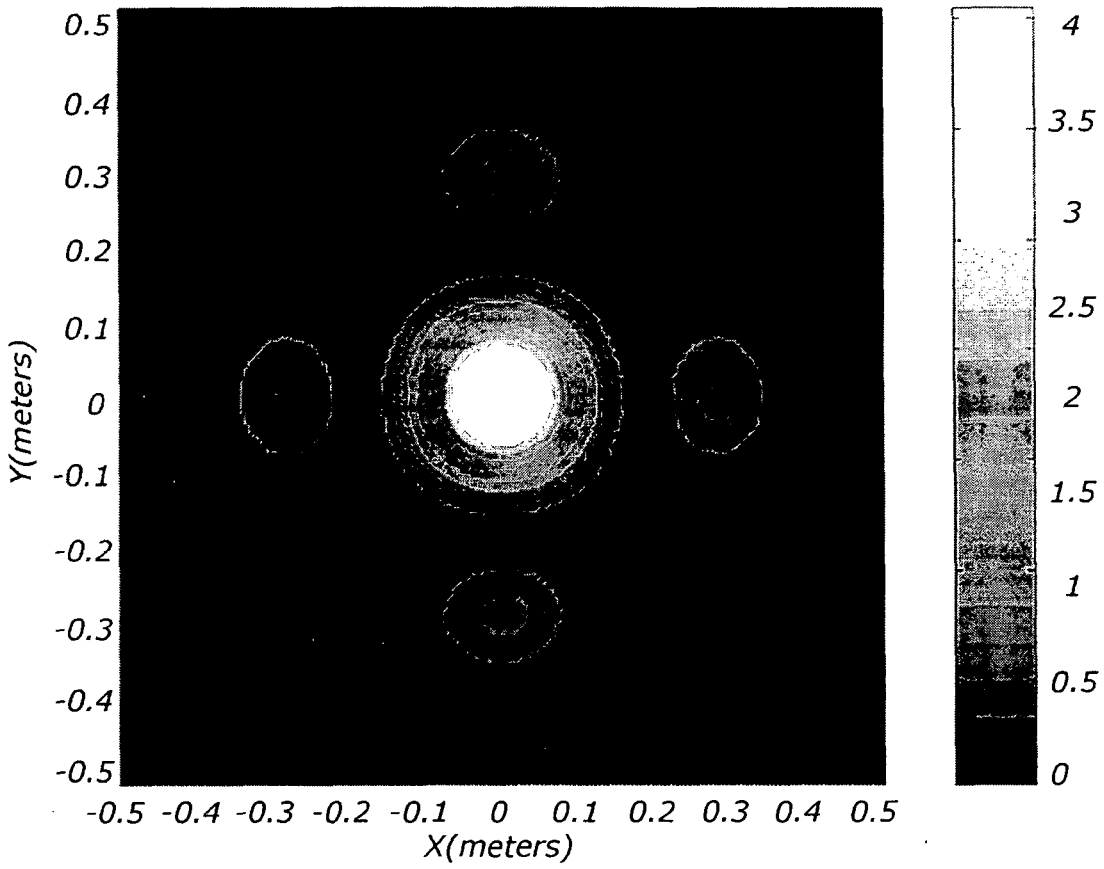
FIG. 9 is an interference pattern for when the array is focused to maximize on-axis power density such that the field radiated by each element adds in phase at the target center in accordance with the present teachings.

FIG. 9 is an interference pattern for a normalized power density $P/P_{min}$ at 250 meters radiated by the same 3×3 coherent near-field array used to generate FIG. 4 when the array is focused to maximize on-axis power density, i.e., the phases are chosen so that the fields radiated by the centers of each element add in phase at the target center, in accordance with the present teachings. Ideally, the electric field vectors radiated by each element will be parallel and equal in phase and amplitude so that the resulting electric field is N times that due to a single element, and the power density is $N^2$ that due to a single element. In practice, phase errors arise due to the fact that the path length to the target varies over the surface of each element varies from that at the center of each element, so that the fields radiated by each element do not add in phase at the target, and the electric fields are not perfectly aligned. As a result, ideal performance may not be realized.

In FIG. 9, the peak normalized power density is increased from its single-element value of 0.127 to 7.147, a gain of 56.3. The phase $\Phi_n$ of each element is chosen so that $$k\sqrt{(x-x_n)^2+(y-y_n)^2+L^2}+\Phi_n=\theta_0+2\pi m, \quad [9]$$

where $\theta_0$ is an arbitrary phase and m is an integer. The peak normalized power density is 7.147; compare this to the peak value of 0.127 realized by a single element as plotted in FIG. 6. When the array is focused on the target point in this manner, a gain in power density of 56.3 is realized, which as expected is smaller than the ideal value of $N^2=81$. This demonstrates that a coherent near-field array can be used to generate multiple medium power density spots or a single high-power density spot when the phases are adjusted appropriately. This change can be made in real time as the situation warrants.

Several illustrative alternative embodiments are listed below which differ in the arrangement by which the individual elements of the array are fed with radio-frequency energy (encompassing the microwave and millimeter-wave portions of the electromagnetic spectrum):

1. Each element may be a reflector antenna (e.g., offset Cassegrain or Gregorian) with its own individual feed and source of radio-frequency energy.
2. Each of N elements may be a reflector antenna and one or more shaped subreflectors may be used to subdivide a single high-power input beam into N output beams, each of which illuminates one array element. The power radiated by each element is ideally equal to the power incident on that element.
3. Each element may be an active array antenna (e.g., a quasi-optical grid amplifier or a reflect array) and one or more shaped subreflectors may be used to subdivide a single low-power input beam and generate N output beams, each of which illuminates one active array element. The power radiated by each element is equal to the power incident on the element multiplied by the gain of the active array element.
4. Each element may be an active array (e.g., a quasi-optical grid amplifier or a reflect array) with its own separate feed and source of radio-frequency energy.
5. Each element may be a passive phased array with its own separate feed system and source of radio-frequency energy.
6. Each element may be a passive radiating element (e.g. a horn antenna) fed its own source of radio-frequency energy.
7. Each element may be a passive radiating element (e.g. a reflecting antenna or a horn antenna) fed by a common feed system and a single common source of radio-frequency energy.

Those skilled in the art will appreciate that other embodiments that differ in the arrangement by which the individual elements of the array are fed with radio-frequency energy may be used without departing from the scope of the present teachings.

Embodiments 2, 3, and 7 are attractive in that they require only a single source of millimeter-wave power, which simplifies the layout of the system. However, an architecture of this type leaves the system vulnerable to a single-point failure; if the source fails, the system becomes inoperable.

Embodiments 1, 4, 5, and 6 overcome this vulnerability by utilizing multiple sources of millimeter-wave power. If a single source fails, the system can continue to operate at a reduced capacity.

Figure 10A:
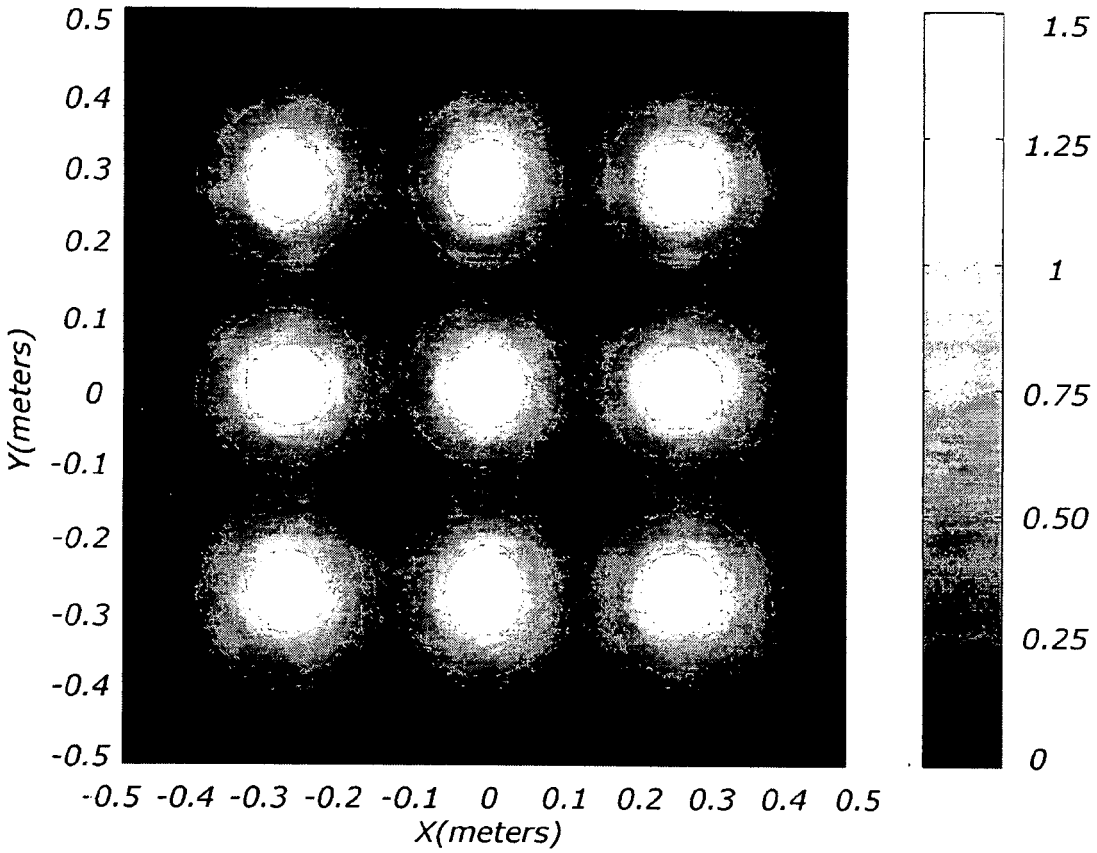
FIGS. 10*a*-10*c* illustrate the effects of a single-element failure on the normalized power density at a range of 250 meters for the same array whose power density is plotted in FIG. 4.
Figure 10B:
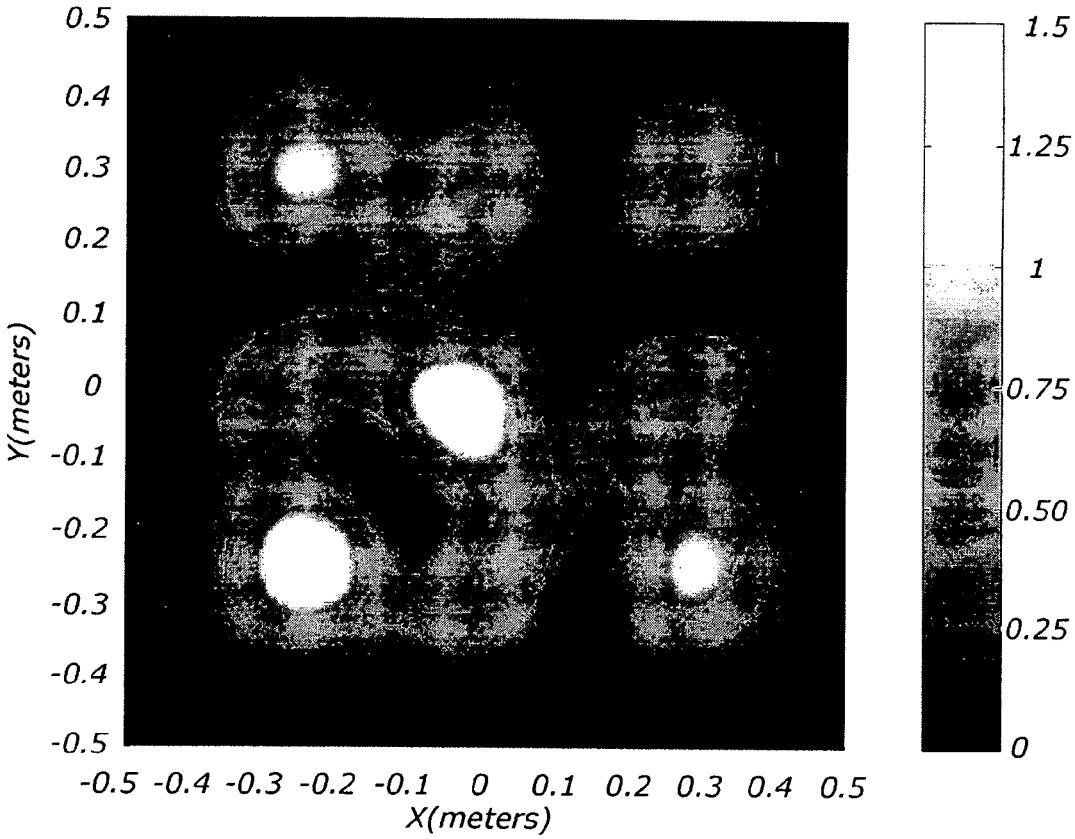
Figure 10C:
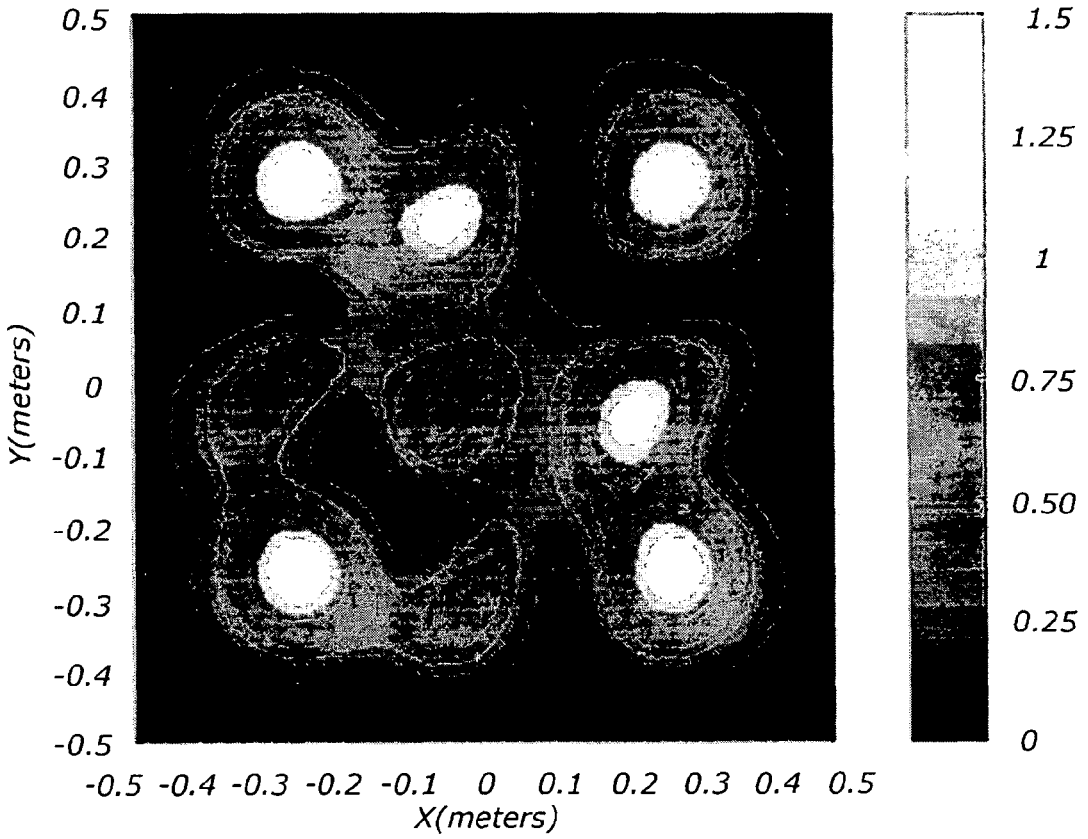

FIGS. 10*a*-10*c* show a set of interference patterns for a normalized power density $P/P_{min}$ radiated by a 3×3 coherent near-field array at a distance of 250 meters in accordance with the present teachings. FIGS. 10*a*-10*c* show the effects of a single-element failure on the normalized power density at a range of 250 meters for the same array whose power density is plotted in FIG. 4. As shown in FIG. 10*a*, with all nine elements functional (as in FIG. 4 but on a different scale), all nine peaks lie above the normalized power density threshold of 1.0.

FIG. 10*b* shows that with one failed element (element #1) and no compensation, only 4 peaks lie above the power density threshold ($P/P_{min}>1$).

FIG. 10*c* shows that with one failed element (element #1) and with the phase of the opposing element (element #9) adjusted to better equalize the power density, 6 peaks lie above the power density threshold.

FIGS. 10*b* and 10*c* show the power density in the event that Element #1 (lower left corner as seen in FIG. 1) has failed. In FIG. 10*b*, the phase of each functioning element is identical to that in FIG. 10*a*. It is evident that the power density is skewed towards the lower left corner of the target area. The power density can be adjusted to obtain a better distribution over the target area by adjusting the phases of the remaining elements. Perhaps the simplest method is to adjust only the phase of the diametrically-opposed element, which in this case is Element #9 (upper right-hand corner as seen in FIG. 1). A more uniform power distribution is obtained, as shown in FIG. 10*c*, by adjusting the phase of Element #9 from its nominal value of 280° to 330°. Those skilled in the art will appreciate that other methods of phase adjustment can be implemented to adjust the power density in the event of an element failure without departing from the scope of the present teachings.

Finally, embodiment #5 above offers the potential to eliminate the need for mechanical actuators by steering each beam to the target area electronically.

The present invention can be utilized in a number of different applications. One can envision a vehicle-mounted system that uses a deployable lightweight rigid lattice to support the individual antennas and their feed networks. In such a system, the individual elements would likely be arranged in a pattern similar to that illustrated in FIG. 1. However, the radiating elements need not be in close proximity. In fact, such an arrangement is not convenient or even possible in some deployment scenarios. In a shipboard application, for example, a large number of antennas can only be distributed over a wide area in available locations around the ship. By pointing each element at the desired target area and applying the proper phase, the antenna elements can be made to work together to create a desired power density pattern where needed, even if the elements are not arranged on a regular grid. A distributed array of this type becomes even more flexible and easily deployed when each element is a phased array, since the need to mechanically point each element is substantially eliminated.

Each phased array element can be mounted on nearly any flat surface (an otherwise unoccupied bulkhead, for example) having a view of all or part of the target area. The on-axis power density that can be achieved with an 8×3 array of 1.5 meter square apertures having a horizontal spacing of 7 meters and a vertical spacing of 4 meters as shown in FIG. 11.

Figure 11:
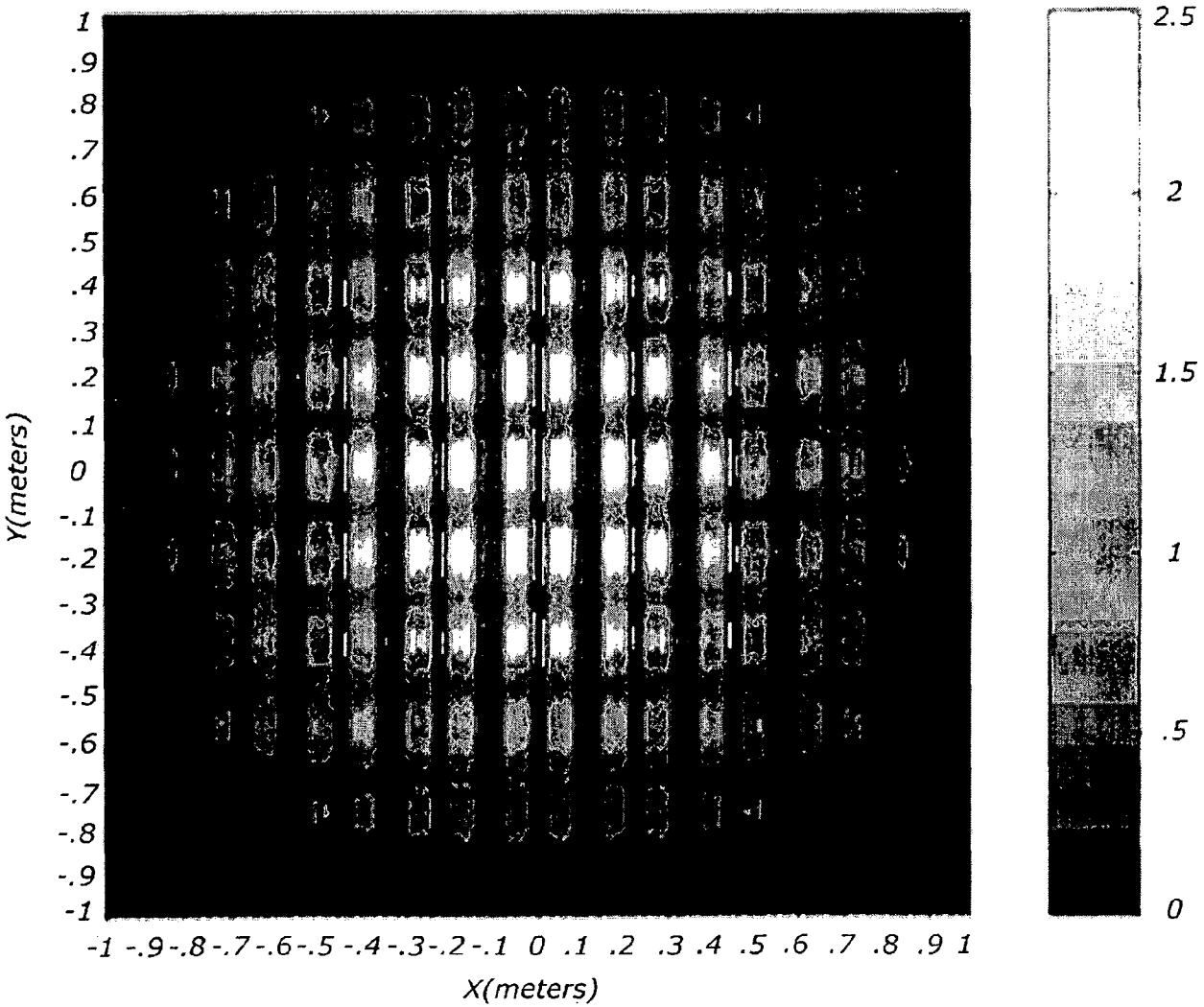
FIG. 11 is an interference pattern with normalized on-axis power density $P/P_{min}$ radiated by a rectangular 8×3 coherent near-field array at a distance of 500 meters in accordance with the present teachings.

FIG. 11 is an interference pattern radiated by a rectangular 8×3 coherent near-field array at a distance of 500 meters in accordance with the present teachings. In this embodiment, each element measures 1.5 meters on a side, and the element-to-element spacing is 7 meters in x and 4 meters in y. For this array $\delta\theta=115°$ and the total radiated power is $2.5P_0$; that is, with a 24 element array one can blanket a larger area at 500 meters than at 250 meters using only 2.5 times the total power. In accordance with the present teachings, the array can also be steered to illuminate off-axis targets.

Figure 12:
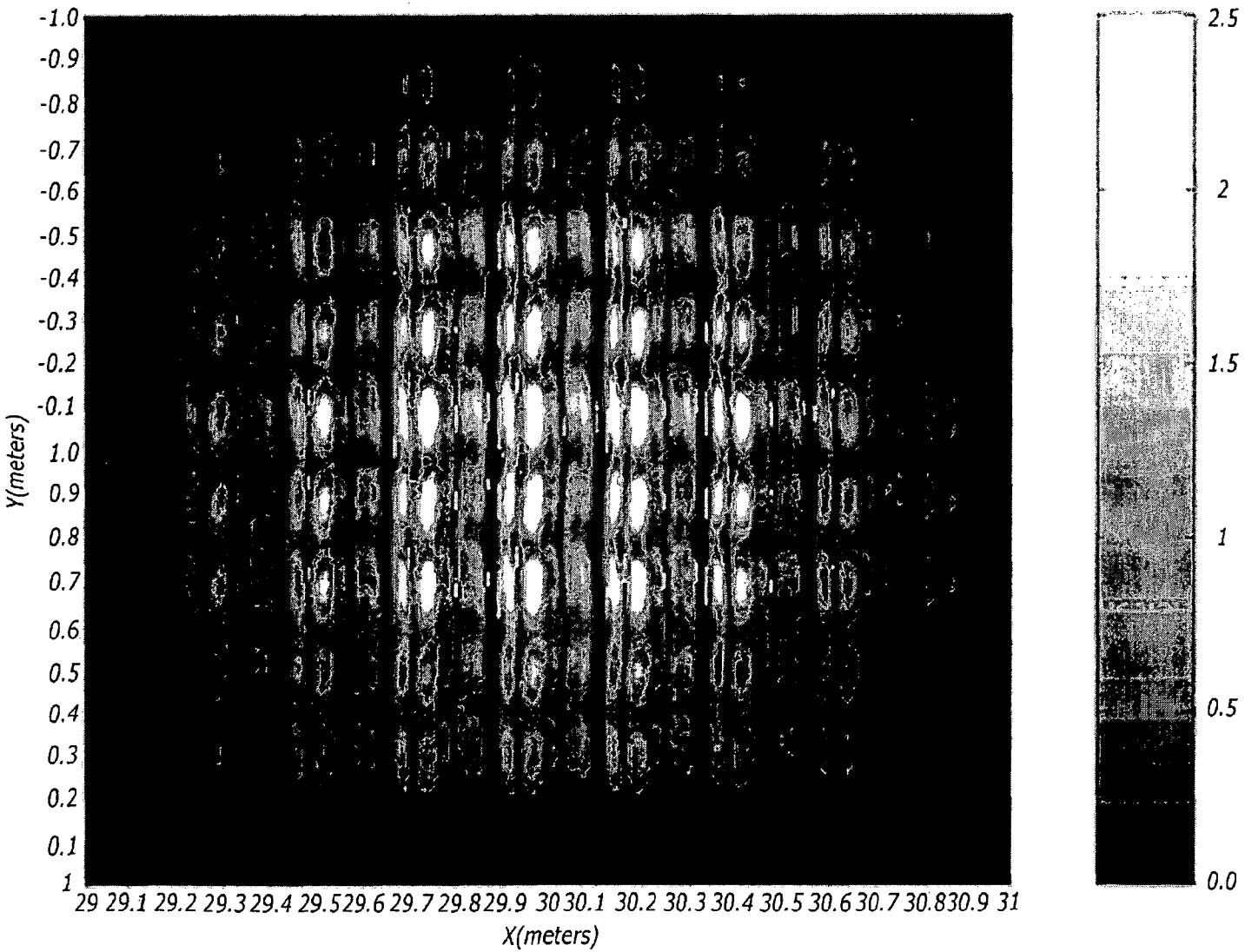
FIG. 12 shows the power density for the same array used to generate FIG. 11, but with each element pointed at a target displaced from the axis by 30 meters along the 'x' axis and 10 meters along the 'y' axis.

FIG. 12 shows the power density for the same array used to generate FIG. 11, but with each element pointed at a target displaced from the axis by 30 meters along the 'x' axis and 10 meters along the 'y' axis. Hence, FIG. 12 is an interference pattern with normalized off-axis power density $P/P_{min}$ radiated by a rectangular 8×3 coherent near-field array at a distance of 500 meters. In this embodiment, each element is steered to point at a target located at x=30 meters, y=10 meters, z=500 meters. Each element measures 1.5 meters on a side and the element-to-element spacing is 7 meters along the 'x' axis and 4 meters along the 'y' axis. The total radiated power is $2.5P_0$ and $\delta\theta=120°$.

Note that such a system can deal with multiple simultaneous threats by generating multiple beams at different locations if sufficient power is available. In this mode of operation, the distributed array acts as two or more separate arrays each illuminating a different target with patterns similar to those shown in FIGS. 1-9. In a similar manner, such a system can be deployed on a large fixed-wing aircraft, such as a C-130. As the aircraft must fly at a safe altitude, the range required of such a system will be significantly larger than in a shipboard defense application, requiring that the array be constructed from a smaller number of very high gain elements.

Coherent near-field arrays can be deployed to protect the interiors and exteriors of sensitive facilities (commercial as well as military) from intruders. Two sets of antennas are required to protect both the inside and the outside of a facility, but the RF sources (currently the most expensive part of a high-power millimeter-wave system) need not be duplicated. One can simply redirect the outputs from outside to inside as required. The cost of millimeter-wave power will fall dramatically as w-band solid-state technology advances. Eventually, it may be cost effective to deploy separate arrays to protect both the inside and outside of a facility.

Another application in which the distances between radiating elements are large and irregular is area defense. For example, one might use several small vehicle-mounted systems to defend an area (an airport, for example). Each vehicle might support a single small transmitter and a single antenna and have a limited range. By working together, however, several such systems can defend a much larger area. In such a scenario, each vehicle is located within the perimeter of the area to be defended while still in relatively close proximity to each other.

To illustrate how this might work, suppose three systems are to be used to defend a circular area 400 meters in diameter. The total radiated power from each system is $0.2P_0$ and each aperture is 1.25 meters square. The normalized power density at a range of 200 meters is shown in FIG. 13 when the elements are arranged on a circle 50 meters in diameter at angular increments of 120° with the addition of random displacements in angle and radius. Mutual coherence among the array elements is maintained by utilizing a common frequency reference. For example, a reference signal from which the input radio-frequency signal to each element is derived can be broadcast over the airwaves to each array element.

Figure 13A:
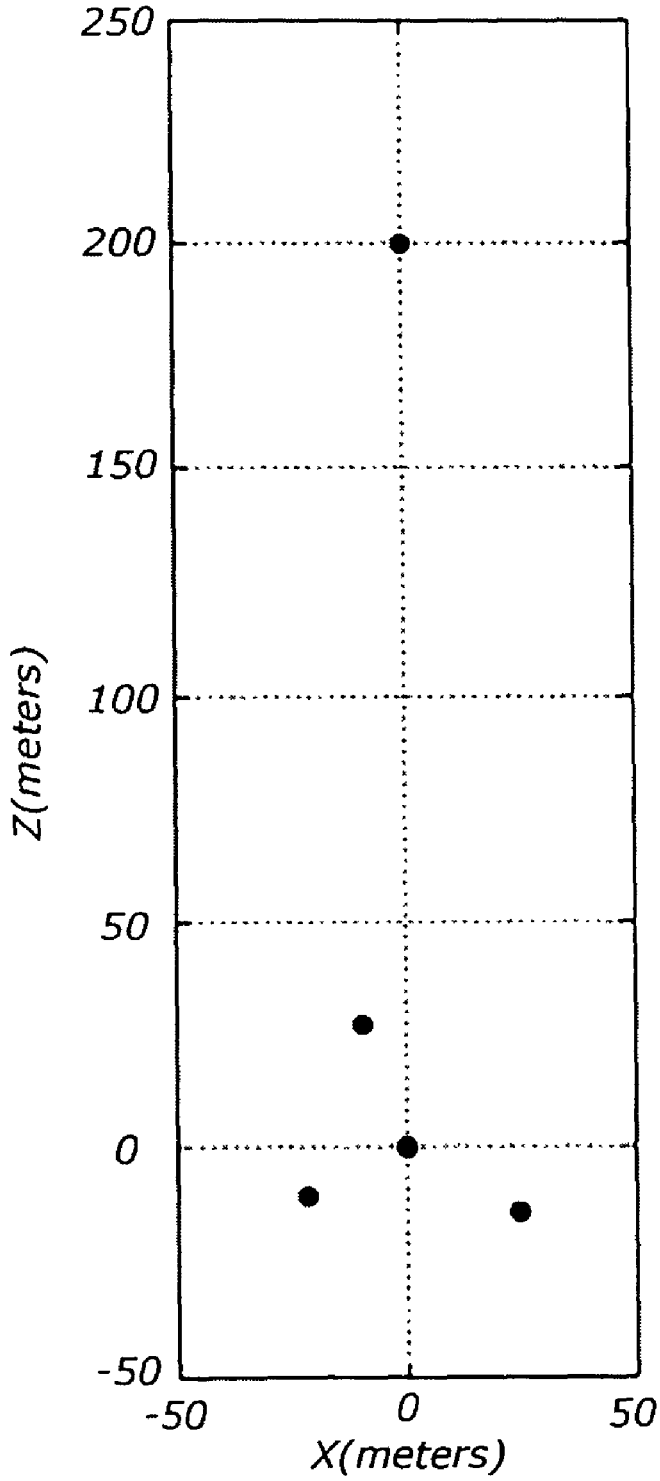
FIG. 13*a* is a graph showing the locations of elements of a quasi-circular three-element un-phased coherent near-field array.

FIG. 13 shows a set of graphs for a quasi-circular three-element array which radiates a normalized power density $P/P_{min}$. FIG. 13*a* shows the locations of the three array elements as well as the target point located at x=0, y=0, z=200 meters. In FIG. 13*a*, the unfilled circles represent the array elements and the filled circle is the target point. The three elements are arranged on a circle at 120-degree increments on a circle 50 meters in diameter. Each element is given a random displacement of $-5$ meters$<\Delta R<5$ meters in radius and $-30°<\Delta\theta<30°$ in angular displacement. Each element is steered to point at a target located at x=0 meters, y=0 meters, z=200 meters.

Figure 13B:
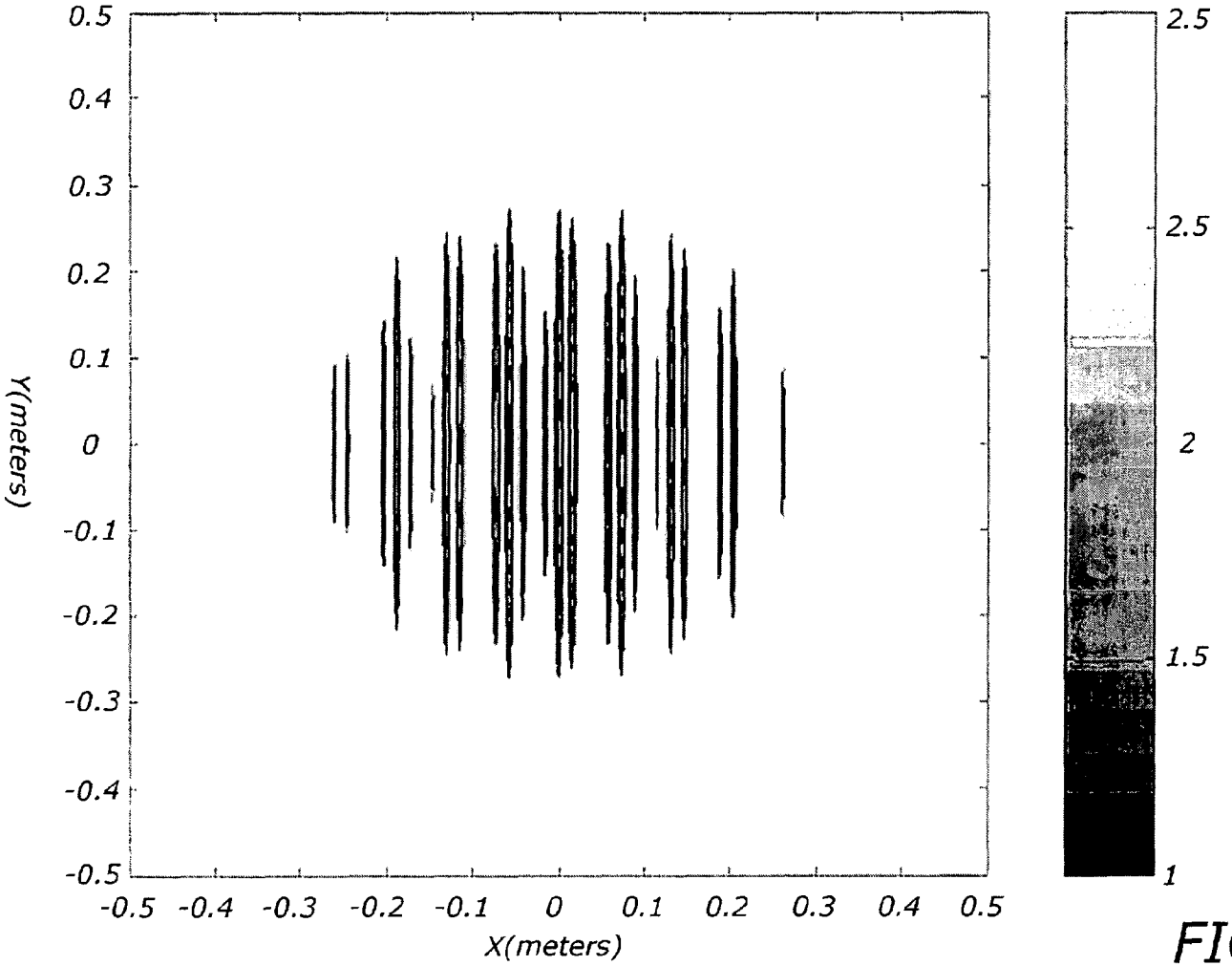
FIG. 13*b* is a graph showing the normalized above-threshold power density $P/P_{min}>1$ projected on the target area by the un-phased array of FIG. 13*a*.

FIG. 13*b* shows the power density radiated by the three-element array. Each element measures 1.25 meters on a side and radiates $0.2P_0$. Use of such a system in the field is simplified if the individual elements need not be precisely located with respect to one another. In the illustrative embodiment, each element is given a random displacement of $-5$ meters$<\Delta R<5$ meters in radius and $-30°<\Delta\theta<30°$ in angular displacement, as shown by the circles in FIG. 13*a* and each element is steered to point at a target located at x=0 meters, y=0 meters, z=200 meters, indicated by the filled circle in the same figure. Use of such a system in the field is further simplified if the phase of each element need not be fixed to a specific value. The phase of each element is a random number whose distribution is uniform over the interval from 0° to 360°. As the phases of each element are uncontrolled, this is an example of an un-phased array. The resulting normalized above-threshold power density $P/P_{min}>1$ is shown in FIG. 13*b*.

Through interference between the three beams above-threshold power density is obtained over a circle approximately one-half meter in diameter. Similar performance can be expected for target points located at all points on the perimeter of a circle 400 meters in diameter surrounding the three elements.

The deployment scenarios considered so far assume that the elements of the array are fixed with respect to each other. By relaxing this constraint we can contemplate scenarios in which each element is installed on a separate mobile platform, e.g., a land vehicle, a small ship, or a remotely-piloted vehicle (RPV), and in which each element may be in relative motion with respect to all other elements.

The frequency of each source can be controlled by broadcasting a synchronization signal to all elements. The frequency of this signal can be much lower than the desired output frequency. For example, if the broadcast synchronization signal is a sinusoid at 1 GHz and the desired output frequency is 95 GHz, each element can multiply the frequency of the received synchronization signal by a factor of 95 to obtain a suitable input signal, which can then be used to drive that element's millimeter-wave source.

On the other hand, in such an implementation it will be difficult to exercise tight control over the phases of each element or to adjust each in real time to compensate for relative motion of the array elements. The large distances between neighboring elements make this unnecessary, however, as the distance between neighboring peaks will be so small that numerous high-amplitude peaks will exist even without favorable element phasing.

For example, consider an un-phased array of four 2.5 meter by 2.5 meter elements, each attached to an RPV at an approximate altitude of 2 km and each radiating $5P_0$ (for a total radiated power of $20P_0$). The phase of each individual element is a random constant and is uniformly distributed over the interval between 0° and 360°.

Figure 14A:
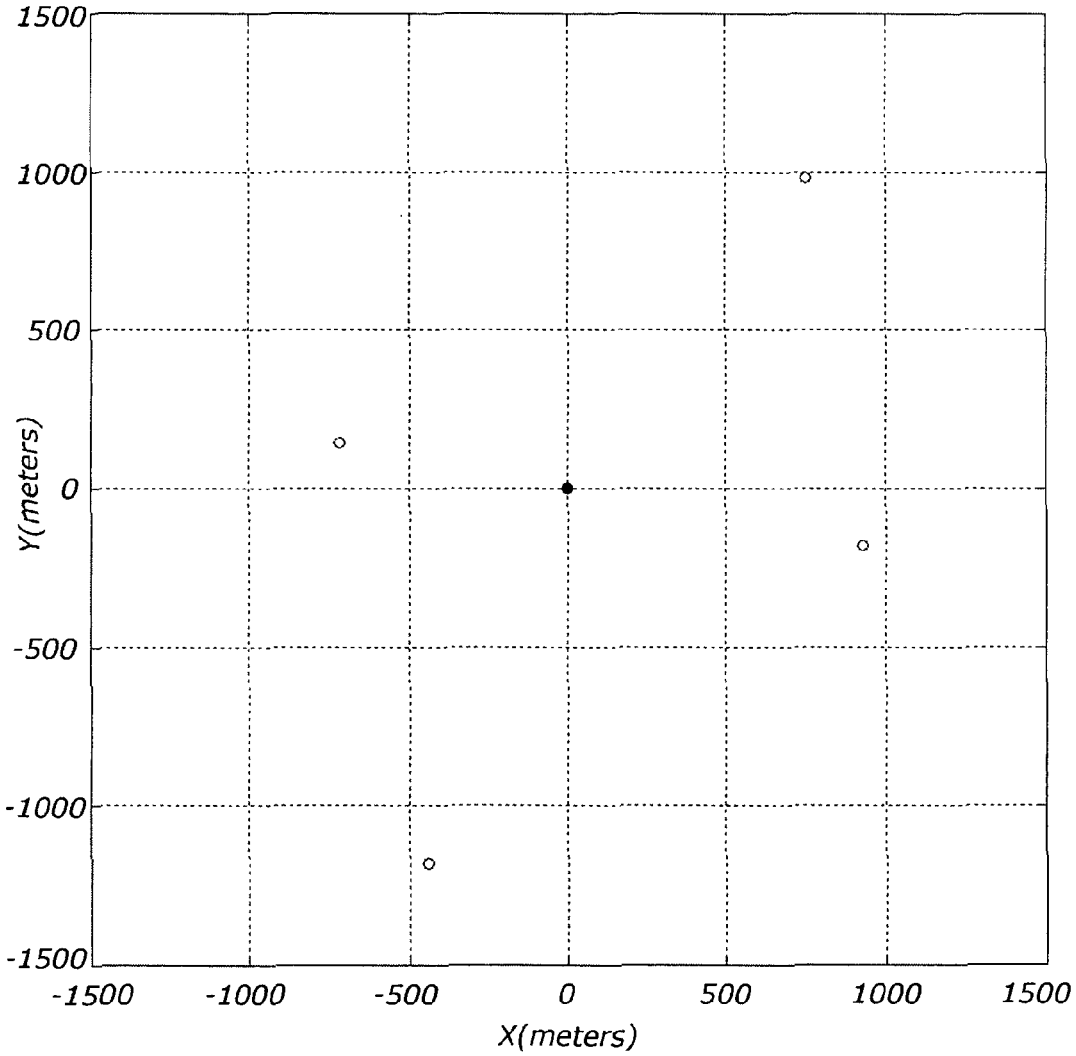
FIG. 14*a* is a graph showing the locations of elements of a four-element un-phased coherent near-field array.

FIG. 14*a* is a graph showing the locations of elements of a four-element un-phased coherent near-field array. The unfilled circles represent the individual elements. The target point at (x,y,z)=(0,0,0) is denoted by a filled circle. The four elements are arranged at 90-degree increments on a circle 2000 meters in diameter, with x and y coordinates as shown in FIG. 14*a*. Each element is given uniformly-distributed random displacements in radius and angle of $-500$ meters$<\Delta R<500$ meters and $-30°<\Delta\theta<30°$, respectively. The center of the target area being illuminated is at (x,y,z)=(0,0,0).

Figure 14B:
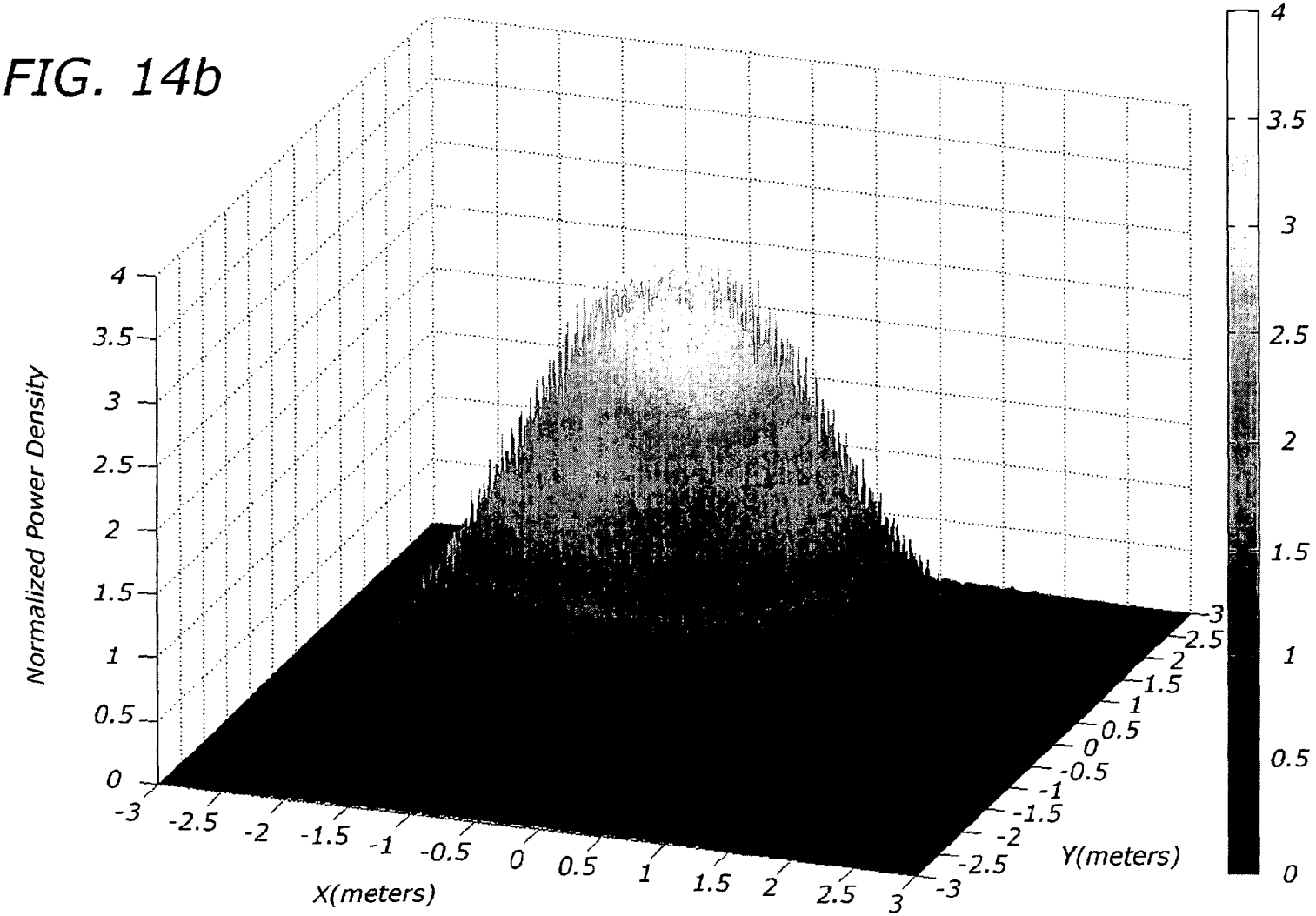
FIG. 14*b* is a graph showing the power density projected on the target area by the un-phased array of FIG. 14*a*.

FIG. 14*b* is a graph showing the normalized power density $P/P_{min}$ projected on the target area by the un-phased array of FIG. 14*a*. The calculated power density is sampled at a rate of one point per centimeter in both x and y dimensions. Each element measures 2.5 meters on a side and is steered to point at the target located at (x,y,z)=(0,0,0). The total radiated power is $20P_0$. The array satisfies $P_d \geqq P_{min}$ over a target area approximately 3.0 meters in diameter.

Figure 14C:
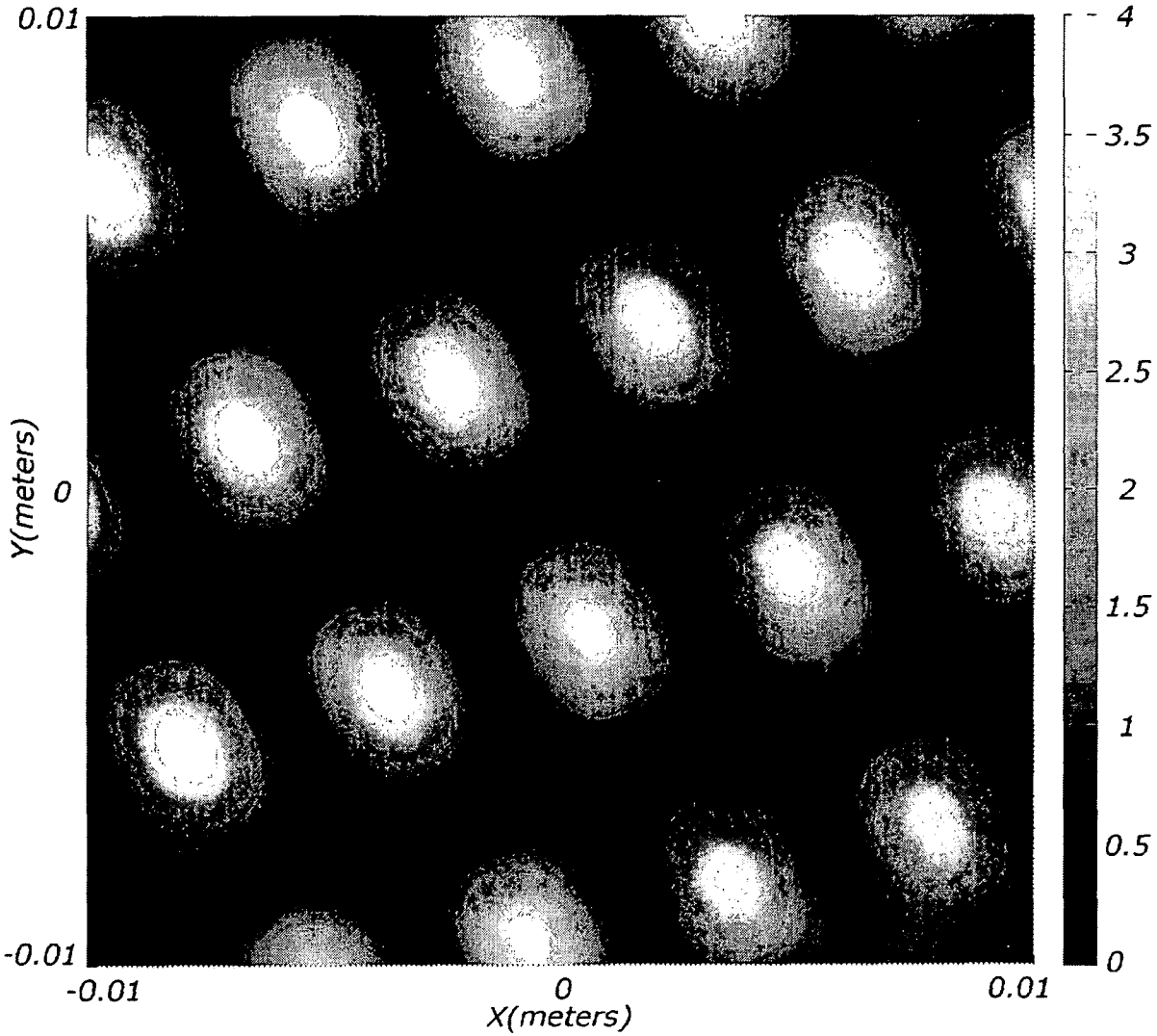
FIG. 14*c* is a graph showing the power density projected on a 2 cm by 2 cm square at the center of the target area shown in FIG. 14*b* by the un-phased array of FIG. 14*a*.

FIG. 14*c* is a graph showing the calculated normalized power density $P/P_{min}$ projected on a 2 cm by 2 cm square at the center of the target area by the un-phased array of FIG. 14*a*. The sampling density here is 1000 points per centimeter in both x and y dimensions. FIG. 14*c* clearly shows that the interference pattern consists of numerous hot spots over which the power density satisfies $P \geqq P_{min}$ and falls to a minimal value between hot spots.

The effectiveness of a coherent near-field array will be increased if feedback is used to adjust the phases of the individual elements. One way of implementing feedback is to use an infrared imaging system such as a FLIR (Forward-Looking. Infrared) sensor to monitor the target area. For example, in a millimeter-wave non-lethal directed-energy application, a definite IR signature will be visible as the incident millimeter-wave radiation heats the skin of individuals (or other millimeter-wave absorbing objects) in the target area. The resulting IR image is a measure of the power density in the target area. An image-processing algorithm implemented in computer software can be used to compare the observed power density to the desired power density and to derive error signals that drive phase shifters at the input of each array element. A feedback system of this type can also be used to adjust the spot pattern on the fly, for example to focus the beam on a particular individual, or to adjust the power density pattern in the event of an element failure.

FIG. 15 is a simplified diagram of an illustrative closed-loop implementation in accordance with the present teachings. In this embodiment, an infrared camera 70 is mounted on top of the array 10. The output of the camera 70 is fed to an infrared image processing system 80. The output of the processing system 80 may be fed to the controller 50 disclosed above. The controller 50 actuates to adjust the phase, frequency, amplitude and/or pointing angle of one or more elements to optimize the pattern on the target for a given application.

FIG. 16*a* shows an illustrative downrange thermal signature received by the camera 70 of FIG. 15 in accordance with the present teachings.

FIG. 16*b* shows a desired downrange thermal signature received by the camera 70 of FIG. 15 as a result of the effect of the controller 50 in accordance with the present teachings.

Figure 17:
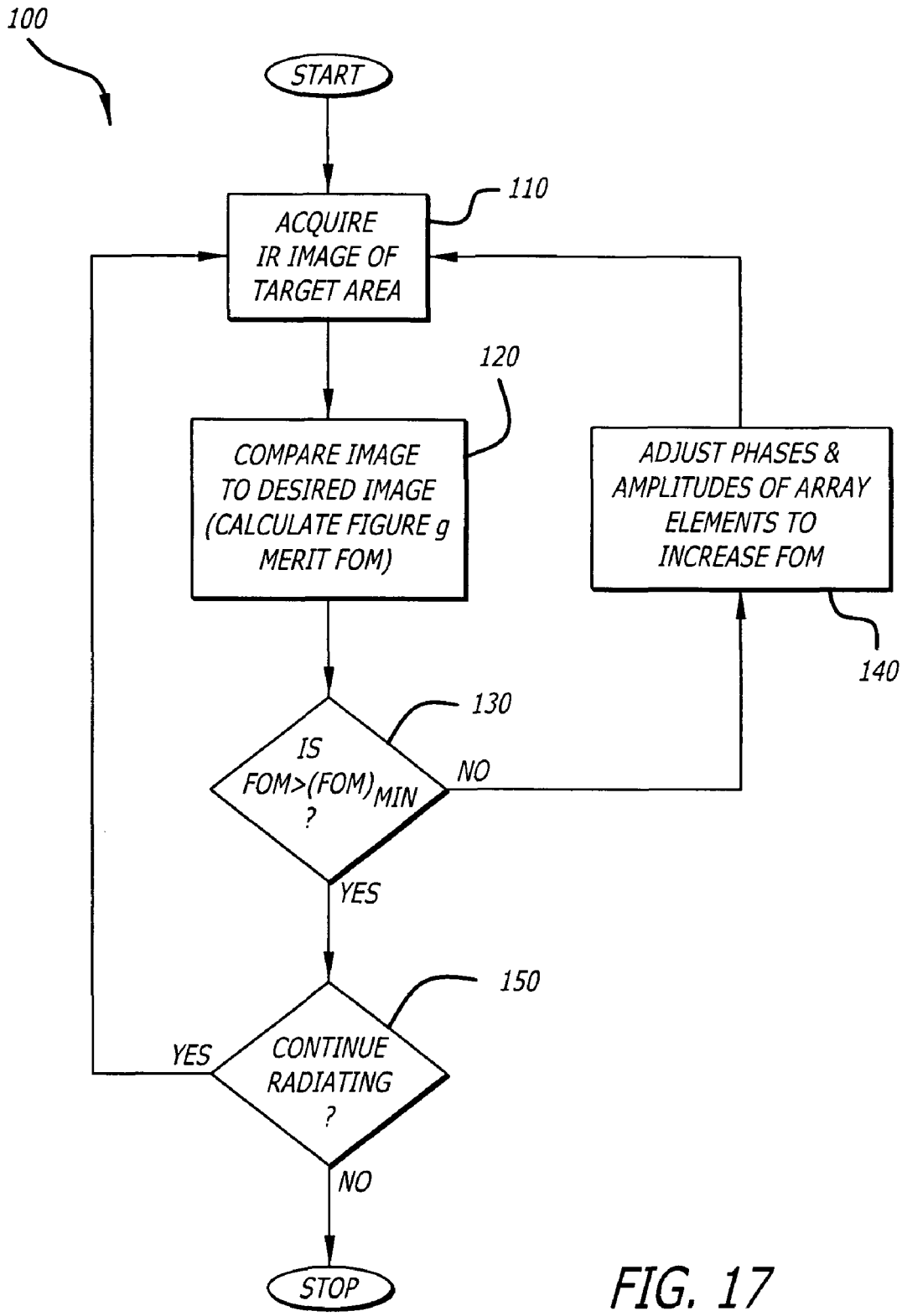
FIG. 17 is a flow diagram of an illustrative implementation of the closed-loop control method implemented by the system of FIG. 15.

FIG. 17 is a flow diagram of an illustrative implementation of the closed-loop control method implemented by the system of FIG. 15. The method 100 includes the steps of acquiring an infrared image of a target area (step 110), comparing the image to a desired image (such as that shown in FIG. 16*b*) and calculating a figure of merit (FOM) (step 120). At step 130, the system tests the FOM to determine whether it exceeds a minimum threshold. If not, the phase, amplitude, and/or pointing angle of one or more elements of the radiating or reflecting array are adjusted at step 140 and the system loops back to step 110.

If at step 130, the FOM threshold is exceeded, then at step 150, the system decides whether to continue operating by looping back to step 110 or terminate the operation.

Thus the present invention reduces the total required radiated power by illuminating the target area non-uniformly with a number of smaller spots over which $P_d \geqq P_{min}$ with minimal illumination between spots.

Potential uses for the present invention are not limited in scope to non-lethal directed energy applications, and the frequency is not limited to the millimeter-wave portion of the electromagnetic spectrum. The present invention has potential medical applications, such as using RF/microwave energy to selectively heat and destroy cancerous tissue. The present invention can be implemented in the visible region of the spectrum using lasers or laser amplifiers as sources and lenses or mirrors in place of antennas. Potential applications include laser cutting and machining, as well as traditional directed-energy applications that currently utilize a single high-power laser. Furthermore, the present invention is not limited in scope to the generation and radiation of electromagnetic waves. The present teachings can be applied as well to the generation and radiation of acoustic waves through solids, liquids or gases.

Numerous implementations are possible within the scope of the present teachings. An acoustic implementation (using speakers or hydrophones, for example) or an optical implementation (using injection-locked laser oscillators or laser amplifiers, for example) would use the same principles, but would differ in implementation details. A block diagram of a generic implementation encompassing these possibilities, among others, is shown in FIG. 18.

Figure 18:
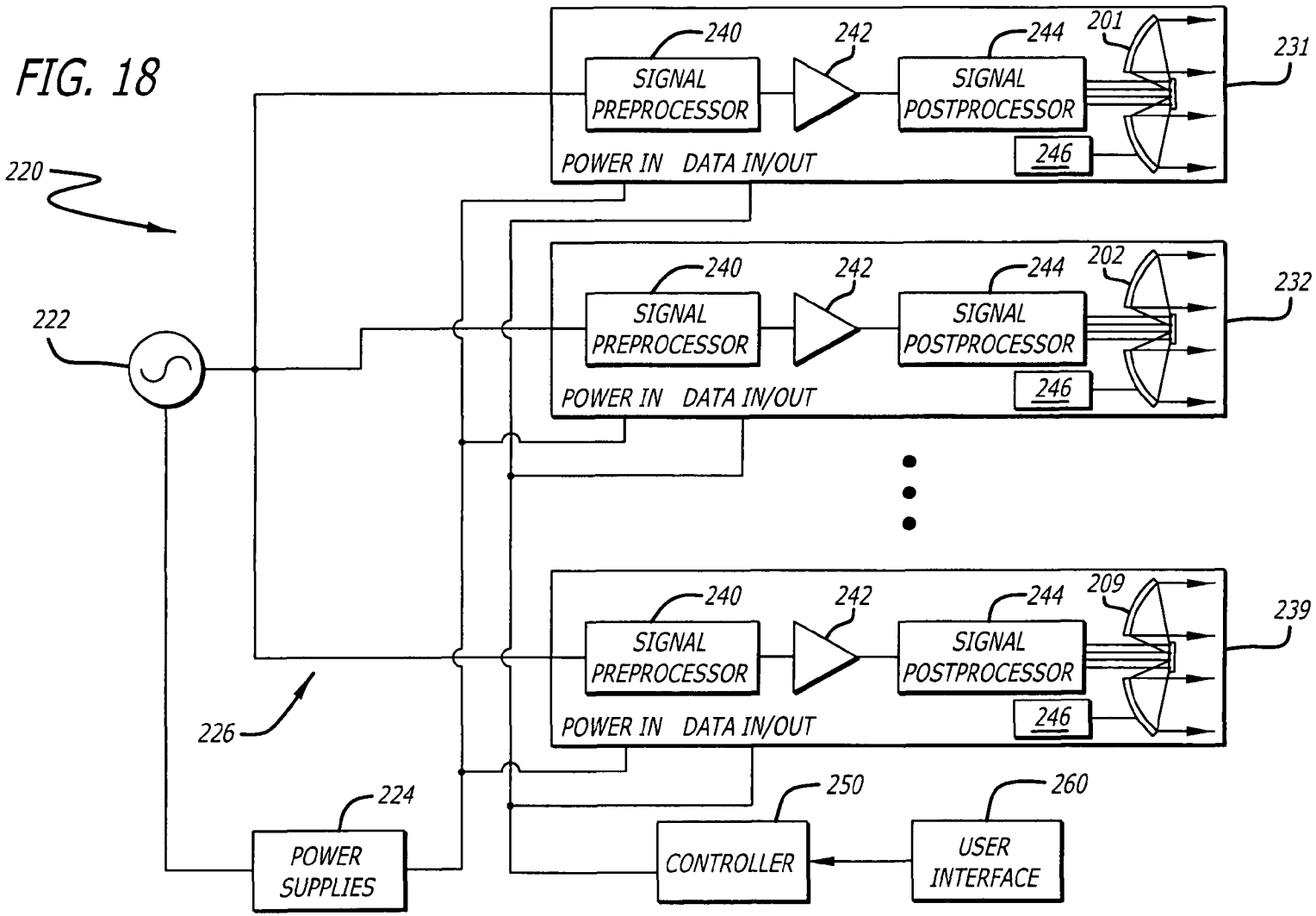
FIG. 18 is a simplified block diagram of a generic implementation of an electrical system for use with the array of the present invention.

FIG. 18 is a simplified block diagram of a generic implementation of the present invention, applicable not only at RF/microwave/millimeter-wave frequencies, but also at optical frequencies. Furthermore, the same generic implementation may be used to implement an acoustic version of the present invention. As shown in FIG. 18, the system 220 includes a master oscillator 222. The system 220 is powered by a power supply 224. The master oscillator 222 provides a common reference frequency to a distribution network 226. The network 226 feeds the input to each of the radiating elements 201-209. In the illustrative implementation, each radiating element 201-209 is disposed within an associated module 231-239, respectively.

In the illustrative generic implementation, each module 231-239 includes a signal preprocessor 240, a gain element 242 (e.g., a power amplifier or an injection- or phase-locked oscillator), a signal post-processor 244, an actuator 246, and a radiating element 201-209. A controller 250 accepts and processes inputs from a user interface 260. The controller 250 uses the processed inputs to regulate the operation of each module; parameters that might be regulated by the controller 250 include the phase of the output signal, the amplitude of the output signal, and the pointing angle (or beam angle if the element is a phased array) of each radiating element. Each radiating element 201-209 (if not the entire module) may be mounted on a gimbal for rotation about at least two orthogonal axes in response to physical actuation by pistons, solenoids, piezoelectric transducers, MEMS devices, or other arrangement known in the art (not shown) in the actuator 246. Those skilled in the art will appreciate that each radiating element 201-209 may be replaced by a phased array without departing from the scope of the present invention.

In an acoustic implementation of the system 220, the master oscillator 222 generates an oscillatory electrical signal at a desired acoustic frequency. This signal is then evenly divided and distributed to the inputs of each of the modules 231-239 by the distribution network 226. The signal preprocessor 240 performs any necessary signal processing necessary to prepare the signal for amplification. Examples of functions that the preprocessor 240 might perform include frequency conversion, pre-amplification, and phase shifting. The signal exiting the preprocessor 240 then enters the gain element 242, which amplifies the input signal to a high power level at the output. While the gain element 242 may be an acoustic amplifier, it may also assume the form of an injection- or phase-locked oscillator. Upon exiting the gain element 242, the amplified acoustic signal enters a signal post-processor 244, whose purpose is to prepare the signal for transmission by each radiating element 201-209. For example, the post-processor 244 may include an impedance transformer to match the output impedance of the gain element to that of the radiating element 201-209. Finally, the radiating element 201-209 launches an acoustic wave into the external medium, which may be liquid, solid, or gas. The radiating element 201-209 may be purely passive, or may include a transducer to convert an electrical input signal into an acoustic output signal. For example, the radiating element 201-209 may assume the form of a hydrophone if the external medium is liquid, a piezoelectric transducer if the external medium is solid, or a speaker if the external medium is gas.

In an optical implementation of the system 220, the master oscillator 222 is a laser that generates a coherent optical signal at a desired frequency. This signal is then evenly divided and distributed to the inputs of each of the modules 231-239 by the distribution network 226. The distribution network may be implemented using mirrors and beamsplitter or using standard fiber-optic components. The distribution network 226 delivers each signal to the input of a signal preprocessor 240 that performs signal processing necessary to prepare the signal for amplification. Examples of processes that the preprocessor 240 might perform include phase shifting, focusing, and collimation. The signal exiting the preprocessor 240 then enters the gain element 242, which amplifies the input signal to a high power level at the output. The gain element 242 may be a laser amplifier (e.g., an erbium-doped fiber amplifier), or it may also assume the form of an injection- or phase-locked laser oscillator. Upon exiting the gain element 242, the amplified optical signal enters a signal post-processor 244, whose purpose is to prepare the signal for transmission by each radiating element 201-209. In an optical implementation, the post-processor 244 may include an array of lenses and/or mirrors to convert the output beam of the gain element to a form suitable for transmission. Finally, the radiating element 201-209 launches a collimated optical beam into the external medium. For example, in a high-power directed-energy application the radiating element 201-209 may consist of an array of mirrors designed to project a spot of a particular size at a desired range.

In summary, a coherent near-field array is disclosed. The array consists of a number of high-gain elements, i.e. elements having gain at or above approximately 20 dB, each of which directs its beam at the desired target area (either mechanically or electronically). Each element is coherently fed, so that the phase relationships between different feeds are constant or slowly varying (e.g., if the individual array elements are in relative motion with respect to one another). Unlike conventional arrays in which the elements are placed close together to prevent the generation of grating lobes, the elements in a coherent near-field array are widely spaced, i.e. spaced many wavelengths apart, and such an array generates an interference pattern consisting of a number of areas of high power density (i.e., "hot spots") separated by areas of lower power density within the target area.

By non-uniformly illuminating the target area, this approach provides adequate coverage of the target for many applications while providing a significant savings in total radiated power compared to the conventional single-beam approach. This savings in total radiated power translates to size, weight, and cost savings at the system level, making it possible, for example, to install a directed-energy system of this type on platforms that cannot support the size and weight of a conventional system.

If each element is itself a phased array antenna, then the individual beams can be steered to the target electronically, eliminating the need for mechanical steering. It is required, however, that the field radiated by each element be coherent with the fields radiated by all other elements.

Thus, the present invention has been described herein with reference to a particular embodiment for a particular application. Those having ordinary skill in the art and access to the present teachings will recognize additional modifications applications and embodiments within the scope thereof. Moreover, the present invention has been described herein with reference to a generic embodiment for general application. Those having ordinary skill in the art and access to the present teachings will recognize additional modifications applications and embodiments within the scope thereof. For example, as mentioned above, one or more elements may be mounted on an independently mobile or fixed platform. The platforms may be spaceborne, airborne, water-based, or land-based, without departing from the scope of the present teachings.

It is therefore intended by the appended claims to cover any and all such applications, modifications and embodiments within the scope of the present invention.

What is claimed is:

1. An antenna array comprising:

a plurality of elements and means for independently steering a beam output by each of said elements to provide multiple overlapping beams that mutually interfere at a target to provide a number of isolated hot spots.

2. The invention of claim 1 further including means for independently activating at least two of said elements.

3. The invention of claim 1 wherein each element is a radiating element.

4. The invention of claim 3 wherein each element has a respective feed.

5. The invention of claim 1 wherein said elements are high-gain elements.

6. The invention of claim 1 wherein said elements are widely-spaced.

7. The invention of claim 1 wherein at least one element is a reflecting element.

8. The invention of claim 1 wherein each element has a respective feed.

9. The invention of claim 1 wherein at least one element is fed by a shaped subreflector.

10. The invention of claim 9 wherein said shaped subreflector divides a single input beam into N output beams.

11. The invention of claim 10 wherein each of said N output beams illuminate a single array element.

12. The invention of claim 1 further including a plurality of sources, each of said sources being coupled to a respective element.

13. The invention of claim 1 wherein at least one element is a phased array.

14. The invention of claim 13 further including means for adjusting a phase relationship between said elements.

15. The invention of claim 13 including means for sending a synchronization signal to at least two of said elements.

16. The invention of claim 15 wherein said synchronization signal has a frequency that differs from that of an output signal of said array.

17. The invention of claim 1 wherein each element is mounted on a separate platform.

18. The invention of claim 17 wherein each platform is independently mobile.

19. The invention of claim 18 wherein at least one element is in motion relative to at least one other element.

20. The invention of claim 1 wherein the elements are located in an irregular pattern relative to the other elements in the array.

21. The invention of claim 20 wherein the elements are randomly located.

22. The invention of claim 1 wherein at least one element radiates acoustic energy.

23. The invention of claim 22 wherein each element radiates acoustic energy.

24. The invention of claim 1 wherein at least one element radiates at an optical wavelength.

25. The invention of claim 24 wherein each element radiates at an optical wavelength.

26. The invention of claim 1 including means for adjusting a pattern of energy radiated by said elements.

* * * * *